US006729502B2

(12) United States Patent
Lewis et al.

(10) Patent No.: US 6,729,502 B2
(45) Date of Patent: May 4, 2004

(54) SELF-CONTAINED VISCOUS LIQUID DISPENSER

(75) Inventors: Richard P. Lewis, Marietta, GA (US); Cleary E. Mahaffey, Suwanne, GA (US); Pamela J. Mayberry, Roswell, GA (US); Paul F. Tramontina, Alpharetta, GA (US); David J. Powling, East Grindstead (GB); Mark A. Bennett, Norcross, GA (US); Randall M. Bachtel, Duluth, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 132 days.

(21) Appl. No.: 09/997,278

(22) Filed: Nov. 28, 2001

(65) Prior Publication Data

US 2002/0074354 A1 Jun. 20, 2002

Related U.S. Application Data

(63) Continuation-in-part of application No. 09/741,570, filed on Dec. 19, 2000.

(51) Int. Cl.[7] ..... B65D 5/06

(52) U.S. Cl. ..... 222/181.3; 222/321.3; 222/321.9; 222/341; 222/384

(58) Field of Search ..... 222/153.01, 181.3, 222/321.3, 321.9, 341, 375, 383.1, 384

(56) References Cited

U.S. PATENT DOCUMENTS

| | | | | |
|---|---|---|---|---|
| 1,586,398 A | | 5/1926 | Bobrick | |
| 1,844,557 A | * | 2/1932 | Bobrick | 222/181.2 |
| 2,184,439 A | | 12/1939 | Schwarcz | |
| 2,545,988 A | | 3/1951 | Bobrick | |
| 2,605,021 A | | 7/1952 | Churchill et al. | |
| 2,622,539 A | | 12/1952 | Martin | |
| 2,628,569 A | | 2/1953 | Gilmore | |
| 3,533,526 A | | 10/1970 | Adell | |
| 3,721,370 A | | 3/1973 | Blum | |
| 3,952,918 A | | 4/1976 | Poitras et al. | |

(List continued on next page.)

FOREIGN PATENT DOCUMENTS

| | | |
|---|---|---|
| DE | 2254386 | 5/1973 |
| EP | 0395380 | 10/1990 |
| EP | 0498275 A1 | 8/1992 |
| EP | 0530789 B1 | 9/1992 |
| EP | 0659380 A1 | 6/1995 |

(List continued on next page.)

OTHER PUBLICATIONS

EPO Search Report–PCT/US02/05698 Jul. 8, 2002.
U.S. Ser. No. 09/741,570 Filed Dec. 19, 2000.

(List continued on next page.)

*Primary Examiner*—Gene Mancene
*Assistant Examiner*—Melvin A. Cartagena
(74) *Attorney, Agent, or Firm*—Dority & Manning

(57) ABSTRACT

A self-contained viscous liquid dispenser includes a housing defining an internal liquid reservoir, and an opening defined through a front surface of the housing. An insert member is fitted through the opening, extends into the reservoir, and defines an internal pump chamber having a back end open to the reservoir and a front end open to the outside of the housing. A pump cylinder is slidably disposed and retained in the chamber. The pump cylinder is movable within the pump chamber from a rest position to a pressurizing position to pressurize and dispense liquid within the pump chamber through a delivery channel and out a dispensing orifice in the pump cylinder. The pump cylinder may be a multiple component device.

31 Claims, 16 Drawing Sheets

U.S. PATENT DOCUMENTS 3,955,715 A 5/1976 Topor
4,018,363 A 4/1977 Cassia
4,036,406 A 7/1977 Jespersen et al.
D246,338 S 11/1977 Jespersen
4,120,619 A 10/1978 Blackband
4,142,651 A 3/1979 Leopoldi et al.
4,159,788 A 7/1979 Doyel
4,164,306 A 8/1979 Perrin
4,166,553 A 9/1979 Fraterrigo
D253,441 S 11/1979 Tucker
4,174,056 A 11/1979 Loeffler
4,236,655 A 12/1980 Humphries
4,248,398 A 2/1981 Doyel
4,314,658 A 2/1982 Laauwe
4,330,071 A 5/1982 Ohlson
4,349,133 A 9/1982 Christine
4,360,130 A 11/1982 Nishimura et al.
D268,154 S 3/1983 Frassanito
4,394,938 A 7/1983 Frassanito
4,410,108 A 10/1983 Minard
4,421,254 A 12/1983 Spector
4,470,523 A 9/1984 Spector
4,489,857 A 12/1984 Batlas
4,493,440 A * 1/1985 von Buelow et al. ..... 222/109
4,502,617 A 3/1985 Stecker et al.
4,519,530 A 5/1985 Schmidt
4,546,904 A 10/1985 Frassanito
4,561,571 A 12/1985 Chen
4,570,833 A 2/1986 Vanderjagt
4,573,612 A 3/1986 Maddison et al.
4,621,749 A 11/1986 Kanfer
4,646,945 A 3/1987 Steiner et al.
4,650,095 A * 3/1987 Tella et al. ..... 222/153.13
4,660,747 A 4/1987 Borg et al.
4,662,195 A 5/1987 Von Buelow et al.
4,673,109 A 6/1987 Cassia
4,679,709 A 7/1987 Poitras et al.
4,705,195 A 11/1987 Heck
D299,399 S 1/1989 Lippman
4,805,814 A 2/1989 Allen, Sr.
4,811,870 A 3/1989 Bianco
4,834,269 A 5/1989 Cone
4,886,192 A 12/1989 Cassia
4,895,276 A 1/1990 Maldonado
4,949,877 A * 8/1990 Hanna et al. ..... 222/341
4,964,544 A 10/1990 Hanna et al.
D312,184 S 11/1990 De Luca et al.
4,972,973 A 11/1990 Davis
4,972,978 A 11/1990 DeLuca
4,974,753 A 12/1990 Tucker et al.
4,978,036 A 12/1990 Burd
4,991,747 A 2/1991 Van Brocklin
4,993,600 A 2/1991 Tucker et al.
5,042,691 A 8/1991 Maldonado
5,044,900 A 9/1991 Cavallaro
D321,453 S 11/1991 Ophardt
5,079,013 A 1/1992 Belanger
5,131,568 A 7/1992 Ringuette
5,154,328 A 10/1992 Gueret
5,165,577 A 11/1992 Ophardt
5,174,476 A 12/1992 Steiner et al.
D332,544 S 1/1993 Steiner et al.
5,178,300 A 1/1993 Haviv et al.
5,183,182 A 2/1993 Comstock et al.
5,184,760 A 2/1993 Weinstein et al.
5,186,368 A 2/1993 Garcia
5,190,191 A 3/1993 Reyman
5,209,377 A 5/1993 Steiner et al.
5,213,236 A 5/1993 Brown et al.
5,217,147 A 6/1993 Kaufman
5,261,557 A 11/1993 Bytell et al.
5,265,772 A 11/1993 Bartasevich et al.
D342,176 S 12/1993 Steiner et al.
5,275,309 A 1/1994 Baron et al.
5,282,552 A 2/1994 Ophardt
D345,664 S 4/1994 Brandenburg
D345,877 S 4/1994 Brandenburg
5,303,851 A 4/1994 Libit et al.
5,305,916 A 4/1994 Suzuki et al.
5,307,962 A 5/1994 Lin
5,316,135 A 5/1994 Kneer et al.
5,322,198 A 6/1994 Ichikawa
D349,827 S 8/1994 Brandenburg
5,339,995 A 8/1994 Brown et al.
5,339,999 A 8/1994 Montesissa
D350,665 S 9/1994 Ophardt
5,363,993 A 11/1994 Mascitelli et al.
5,373,970 A 12/1994 Ophardt
5,377,877 A 1/1995 Brown et al.
5,379,919 A 1/1995 Gueret
5,409,144 A 4/1995 Brown
5,413,250 A 5/1995 Gueret
5,413,251 A 5/1995 Adamson
D359,408 S 6/1995 Frassanito
5,421,489 A 6/1995 Holzner, Sr. et al.
5,427,279 A 6/1995 Kaufman
5,429,275 A 7/1995 Katz
5,431,309 A 7/1995 Ophardt
5,439,143 A 8/1995 Brown et al.
5,439,144 A 8/1995 Holzner
5,443,236 A 8/1995 Bell et al.
5,452,825 A 9/1995 Comstock et al.
5,464,125 A 11/1995 Daansen
5,489,044 A 2/1996 Ophardt
5,501,372 A 3/1996 Daansen
5,524,793 A 6/1996 O'Neil
5,556,005 A 9/1996 Banks
5,595,324 A 1/1997 Brown et al.
5,597,097 A 1/1997 Morris
D378,035 S 2/1997 Ophardt
5,598,952 A 2/1997 Daansen
5,605,256 A 2/1997 Fan
5,632,418 A 5/1997 Brown
D379,728 S 6/1997 Simon
5,638,989 A 6/1997 Ophardt et al.
5,649,643 A 7/1997 Ridgeway
D383,631 S 9/1997 Wirt et al.
5,667,105 A 9/1997 Hartley et al.
5,676,277 A 10/1997 Ophardt
D386,640 S 11/1997 Wirt et al.
5,687,877 A 11/1997 Smolen, Jr.
D388,990 S 1/1998 Brandenburg et al.
5,704,522 A 1/1998 Orgeolet et al.
D391,431 S 3/1998 Brandenburg et al.
5,725,131 A 3/1998 Bell et al.
5,743,440 A 4/1998 De Laforcade
D395,774 S 7/1998 Phillips et al.
5,779,109 A 7/1998 Gueret
5,799,826 A 9/1998 Brown et al.
5,799,841 A 9/1998 Wirt
5,810,203 A 9/1998 Brennan
5,810,204 A 9/1998 Devlin et al.
5,816,453 A 10/1998 Spencer et al.
5,823,397 A 10/1998 Gil
5,826,755 A 10/1998 Burd
5,826,756 A * 10/1998 Foster ..... 222/321.3
5,829,640 A 11/1998 Hershey et al.
5,839,614 A 11/1998 Brown
5,842,609 A 12/1998 Higgins et al.
5,842,611 A 12/1998 Vivier
5,850,948 A 12/1998 Garcia et al.

5,860,574 A 1/1999 Shaklin et al.
5,862,956 A 1/1999 Brandenburg et al.
5,865,352 A 2/1999 Leary
5,887,762 A * 3/1999 Hanna ..... 222/321.7
5,897,031 A 4/1999 Wirt et al.
5,899,363 A 5/1999 Bliss, III et al.
5,908,143 A 6/1999 Crossdale et al.
5,927,561 A 7/1999 Foster et al.
5,927,566 A 7/1999 Mueller
5,927,567 A 7/1999 Fillmore
5,944,227 A 8/1999 Schroeder et al.
5,944,234 A 8/1999 Lampe et al.
D414,363 S 9/1999 Daansen
5,947,338 A 9/1999 Budsworth et al.
5,971,232 A 10/1999 Rohr et al.
5,975,360 A 11/1999 Ophardt
6,016,936 A 1/2000 Fan
6,026,993 A * 2/2000 Sperna Weiland ..... 222/480
6,036,058 A 3/2000 Chou
6,070,763 A 6/2000 Gueret
6,076,707 A 6/2000 Feldner
6,089,410 A 7/2000 Ponton
6,089,411 A 7/2000 Baudin et al.
6,112,951 A 9/2000 Mueller
6,112,952 A 9/2000 Hess, III et al.
6,119,902 A 9/2000 Shimada et al.
6,131,773 A 10/2000 Wade et al.
6,131,806 A 10/2000 Hess, III et al.
6,152,330 A 11/2000 Polan
6,186,361 B1 2/2001 Teetsel, III
6,189,740 B1 2/2001 Wade et al.
6,193,112 B1 2/2001 Santagiuliana
6,209,752 B1 4/2001 Mitchell et al.
6,230,935 B1 5/2001 Mack et al.
6,234,361 B1 5/2001 Bloom
6,237,807 B1 5/2001 Uhl et al.
6,240,979 B1 6/2001 Lorscheidt
6,257,844 B1 7/2001 Stern
6,273,297 B1 8/2001 Schalow et al.
6,273,305 B1 8/2001 Fioravanti et al.
6,279,777 B1 8/2001 Goodin et al.
6,321,943 B1 11/2001 Strickler et al.
6,338,442 B1 1/2002 De Laforcade
6,343,724 B1 2/2002 Ophardt et al.
6,345,734 B2 2/2002 Schalow et al.
6,345,736 B1 2/2002 Berry et al.

FOREIGN PATENT DOCUMENTS

FR 2151586 4/1973
FR 2325346 4/1977
FR 2653100 10/1989
GB 818363 8/1959
GB 2155435 9/1985
NL 9201928 6/1994
WO 9716107 5/1997
WO 9809732 3/1998
WO 0068038 11/2000

OTHER PUBLICATIONS

U.S. Ser. No. 09/911,073 Filed Jul. 23, 2001.
U.S. Ser. No. 09/911,361 Filed Jul. 23, 2001.
U.S. Ser. No. 09/964,289 Filed Sep. 26,2001.
U.S. Ser. No. 09/964,290 Filed Sep. 26, 2001.
PCT Search Report–PCT/US01/48975 May 21, 2002.
PCT Search Report–PCT/US01/44905 Apr. 17, 2002.

* cited by examiner

SELF-CONTAINED VISCOUS LIQUID DISPENSER

RELATED APPLICATIONS

The present application is a Continuation-In-Part (CIP) application of U.S. Ser. No. 09/741,570 filed on Dec. 19, 2000.

FIELD OF THE INVENTION

The present invention relates to the field of viscous liquid dispensers, for example soap dispensers.

BACKGROUND OF THE INVENTION

Various configurations and models of liquid dispensers, particularly liquid soap dispensers, are well known in the art. Conventional dispensers typically employed in public restrooms and the like are wall mounted units that typically include a house or structure that is permanently affixed to a wall. These dispensers typically include an access door or member so that the dispenser can be opened by a maintenance person for refilling or servicing. With certain types of dispensers, separate refill cartridges are inserted into the housing structure. With other types of dispensers, the maintenance technician must directly refill a reservoir provided in the housing structure. The dispensers typically include a delivery device, such as a dosing pump, and a device such as a lever or button for actuating the dosing pump. The dispensers may be vented or unvented.

The conventional dispensers depend on the continued maintenance and operability of the housing structure that is permanently affixed to the wall. In other words, if the housing structure, and particularly the dosing pump, is damaged or vandalized, the dispenser becomes inoperable and must be replaced. The conventional dispensers also depend on a supply system wherein additional liquid soap must be separately stored, transported, and loaded into the dispensers. This process entails unnecessary logistic and man power resources.

The present invention is an improvement over existing systems in that it provides a disposable self-contained dispenser with a significantly increased capacity as compared to standard dispensers, is relatively inexpensive, and does not depend on the separate storage and delivery of refill cartridges or bulk volumes of liquid soap.

OBJECTS AND SUMMARY OF THE INVENTION

Objects and advantages of the invention will be set forth in part in the following description, or may be obvious from the description, or may be learned through practice of the invention.

The present invention provides a self-contained viscous liquid dispenser. Although having particular usefulness as a liquid soap dispenser, the dispenser according to the invention is not limited to a liquid soap dispenser and may be utilized in any application wherein it is desired to dispense metered doses of a viscous liquid. The liquid dispenser will be described herein with reference to a soap dispenser for ease of explanation.

The viscous liquid dispenser includes a housing that may be formed of any suitable material. For example, the housing may be molded from relatively inexpensive plastic materials and may have any desired aesthetic shape. The housing also defines an integral sealed internal liquid reservoir. In other words, the liquid reservoir is not a separate component from the housing, such as a cartridge or the like. The housing may be comprised of wall members that give the dispenser its outward appearance and also define the internal liquid reservoir.

A dispensing pump mechanism is disposed at least partially within the reservoir. The pump mechanism has a delivery end that extends out of the reservoir which is actuated by a user to dispense the viscous liquid.

The dispenser also includes a mounting mechanism that is configured as an integral component of the housing. The mounting mechanism allows the dispenser to be detachably connected to complimentary mounting structure on a wall surface. In this way, the dispenser may be easily removed from the wall surface for disposal or recycling once the liquid has been depleted. A new liquid dispenser according to the invention is then attached to the wall surface.

In one embodiment of the invention, the housing comprises a substantially vertical back side that is configured to be placed adjacent to the wall surface. The mounting mechanism is configured in the back side. For example, if the housing is a molded component, the mounting mechanism is molded integral with the back side. The mounting mechanism may comprise a recess that is defined in the back side. The recess may be defined by side walls that have engaging structures defined thereon. These engaging structures interlockingly engage with complimentary structure provided on the wall mounting structure. The wall mounting structure may be, for example, a plate member or similar device that is relatively permanently affixed to the wall. In one embodiment of the engaging structure, the vertical side walls of the recess include at least one angled surface on each vertical side wall. These angled surfaces engage against complimentary angled surfaces on the mounting wall structure similar to a conventional dove-tail configuration. The housing is slidable in a generally vertical direction onto the wall mounting structure so that the angled surfaces of the mounting mechanism slide into engagement against the angled surfaces of the wall mounting structure. Once engaged, the angled surfaces prevent the dispenser from being pulled away from the wall mounting structure. A securing device may be provided on the back side of the housing to prevent relative sliding movement between the housing and the wall mounting structure upon engagement of the angled surfaces. This securing device may be, for example, a simple protrusion disposed on the back side of the housing that engages in a complimentary recess or divot defined in the wall mounting structure.

In one particularly useful embodiment, at least two spaced apart angled surfaces are provided on each vertical wall of the recess that engage against complimentary spaced apart angled surfaces on the wall structure. The spaced apart configuration of the angled surfaces maximizes the surface contact area between the housing and the wall mounting structure without significantly increasing the relative sliding distance between the members.

As mentioned, the housing structure is preferably formed from a relatively inexpensive molded plastic and may comprise separately molded components that are permanently affixed or adhered to each other. For example, the housing may include a front component that is formed separately from and adhered to a back component. It may be desired that the front and back components have different characteristics. For example, it may be desired that the back component is more rigid than the front component to provide enhanced structural support and rigidity to the dispenser mounted on the wall structure. This may be accomplished by simply making the back component thicker than the front component.

It may also be desired to make at least a portion of the housing translucent or clear so that a maintenance technician can easily determine the remaining level of liquid within the reservoir. For example, a window may be provided in the housing. In one particularly useful embodiment, the housing includes a back component that is formed from a translucent material so that the entire volume of the reservoir is visible from the outside.

Any manner of actuator may be provided with the dispenser to allow the user to operate the pump mechanism. For example, in one embodiment, the actuator may comprise a panel member that contributes to the aesthetic appearance of the housing. The panel member may be hinged or otherwise movably connected to the housing member and lie in contact against a delivery end of the pumping mechanism. Upon the user depressing or moving the panel, the pumping mechanism is actuated so that a metered dose of the liquid is dispensed. In an alternate embodiment, the actuator may comprise a member, such as a decorative cap or the like, directly attached to the delivery end of the pump mechanism. In other words, the actuator need not be connected directly to the housing. Various embodiments of aesthetically pleasing actuators may be used in this regard.

The pump mechanism may include a pump chamber that is formed integral with the housing within the reservoir. For example, the housing may comprise a molded plastic component wherein a pump chamber is integrally molded on the interior of the housing. The pump chamber has a back end that is open to the reservoir section of the housing and a front end that is open to the outside of the housing. A pump cylinder is slidably disposed and retained in the chamber. The pump cylinder has a channel defined therethrough and a delivery end extending out of the front end of the chamber. The pump cylinder is retained within the chamber so that it cannot be pulled therefrom. An actuator is configured with the delivery end of the pump cylinder so that the device may be actuated by a user from outside of the housing. A valve mechanism is disposed in the delivery end of the pump cylinder and is configured to close upon the user releasing the actuator to prevent leakage or dripping of liquid from the pump cylinder.

In one embodiment, the pump cylinder is insertable into the pump chamber from its back end. The chamber includes retaining structure, such as a flange member or the like, at its front end to prevent withdrawal of the pump cylinder from the pump chamber through the front end. A cap member or like device is attached to the back end of the pump chamber once the cylinder has been inserted into the chamber. The cap member has an orifice defined therethrough for drawing liquid into the pump chamber. A check valve device, such as a shuttle valve, is disposed in the orifice to close the orifice upon actuation of the pump cylinder.

The valve mechanism disposed in the delivery end of the pump cylinder may comprise a flexible flap member that is movable to an open position by the pressure of the liquid being dispensed. Upon release of the actuator, the flap member automatically returns to a closed position and thus prevents undesired leakage or drippage of the liquid out of the delivery end of the pump cylinder. In one particularly useful embodiment, the valve mechanism comprises a plurality of flap members that define an opening therethrough in their open position, and seal against each other in their closed position.

A vent path is defined into the reservoir to prevent drawing a vacuum therein. In a particularly desired embodiment, the vent is provided in a top surface of the housing structure. Since the housing structure is mounted in use upon a wall surface, there is little concern of the liquid leaking from the vent in the top surface. In other embodiments, the reservoir may be vented through the pump mechanism. However, venting through the pump mechanism may result in undesired leakage through the mechanism, particularly if the pump mechanism is disposed in the lower portion of the housing. Venting may also be accomplished through the valve mechanism in the delivery end of the pump cylinder.

It should be appreciated that the configuration and appearance of the housing is not a limiting feature of the invention. Also, the invention is not limited to the use of any particular type of materials or manufacturing process. Various embodiments of interlocking engagement structure between the back side of the housing and the wall mounting member are also within the scope and spirit of the invention. For example, the engaging structure may include bayonet type fasteners, or the like.

In an alternate embodiment of a pump mechanism that may be used in a dispenser according to the invention, an insert member is inserted through an opening defined in a front surface of the housing. The insert member extends into the reservoir and defines an internal pump chamber having a back end open to the reservoir and a front end open to the outside of the housing. The insert member is attached to the housing at the opening by any suitable mechanism. In one particular embodiment, the housing comprises a plurality of protrusions extending from the front surface and disposed around the opening. The insert member comprises a front flange having a plurality of counter-bored holes defined therethrough into which the protrusions extend upon mounting the insert member into the housing. The protrusions are then heated to a molten state wherein the protrusion material flows into the counter-bored holes and permanently affixes the insert member to the housing upon re-solidifying. If it is desired to recycle or reuse the pump mechanism, a less permanent or temporary type of attachment mechanism may be used to affix the insert member to the housing, such as a releasable adhesive, mechanical connection (i.e., threaded engagement), etc.

At least one seal is disposed between an outer surface of the insert member and the housing to ensure that liquid within the reservoir does not leak out from around the insert member. In one particular embodiment, this seal is a radially inward extending seal disposed around the opening in the housing that engages and seals against an outer surface of the insert member. This seal may be provided on a cylindrical extension of the housing that extends from the front surface into the reservoir. In an alternate embodiment, the seal may be a radially outward extending seal disposed at a forward end of the insert member that engages and seals against a portion of the housing defining the opening. It may be desired to use both types of seals in the same embodiment.

An alternative embodiment of a pump cylinder that may be used with an integrally formed pump chamber or pump chamber insert is also provided. This pump cylinder may include multiple components. For example, in one embodiment, the pump cylinder includes a first component and a second component inserted into a chamber defined in the first component. Longitudinally extending channels in the components align to define a delivery channel through the pump cylinder. This channel terminates at a delivery orifice defined in a delivery end of the pump cylinder. Once combined, the components define a complete pump cylinder that is slidable within the pump chamber from a rest position to a pressurizing position wherein liquid drawn into the pump chamber is pressurized and dispensed through the delivery channel and out the dispensing orifice.

In order to seal the pump cylinder relative to the pump chamber, a first radially extending seal, such as a flange seal, may be provided on the first component of the pump cylinder that slidably engages along a wall defining the pump chamber. A second similar seal may be provided on the second component that also slidably engages along the pump chamber wall.

The invention will be described in greater detail below with reference to particular embodiments illustrated in the figures.

DETAILED DESCRIPTION

Figure 1:
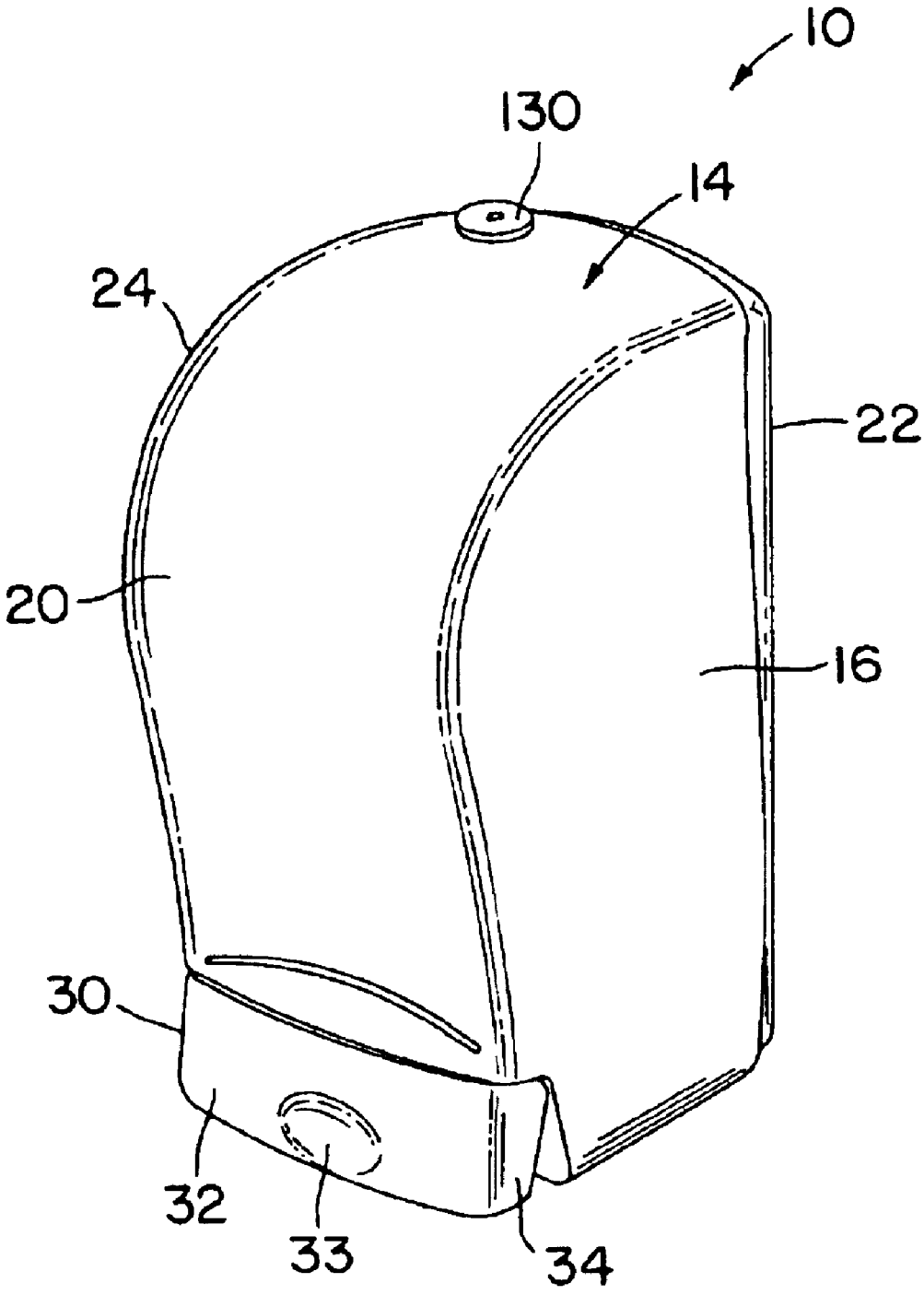
FIG. 1 is a perspective view of a dispenser according to the present invention.
Figure 2:
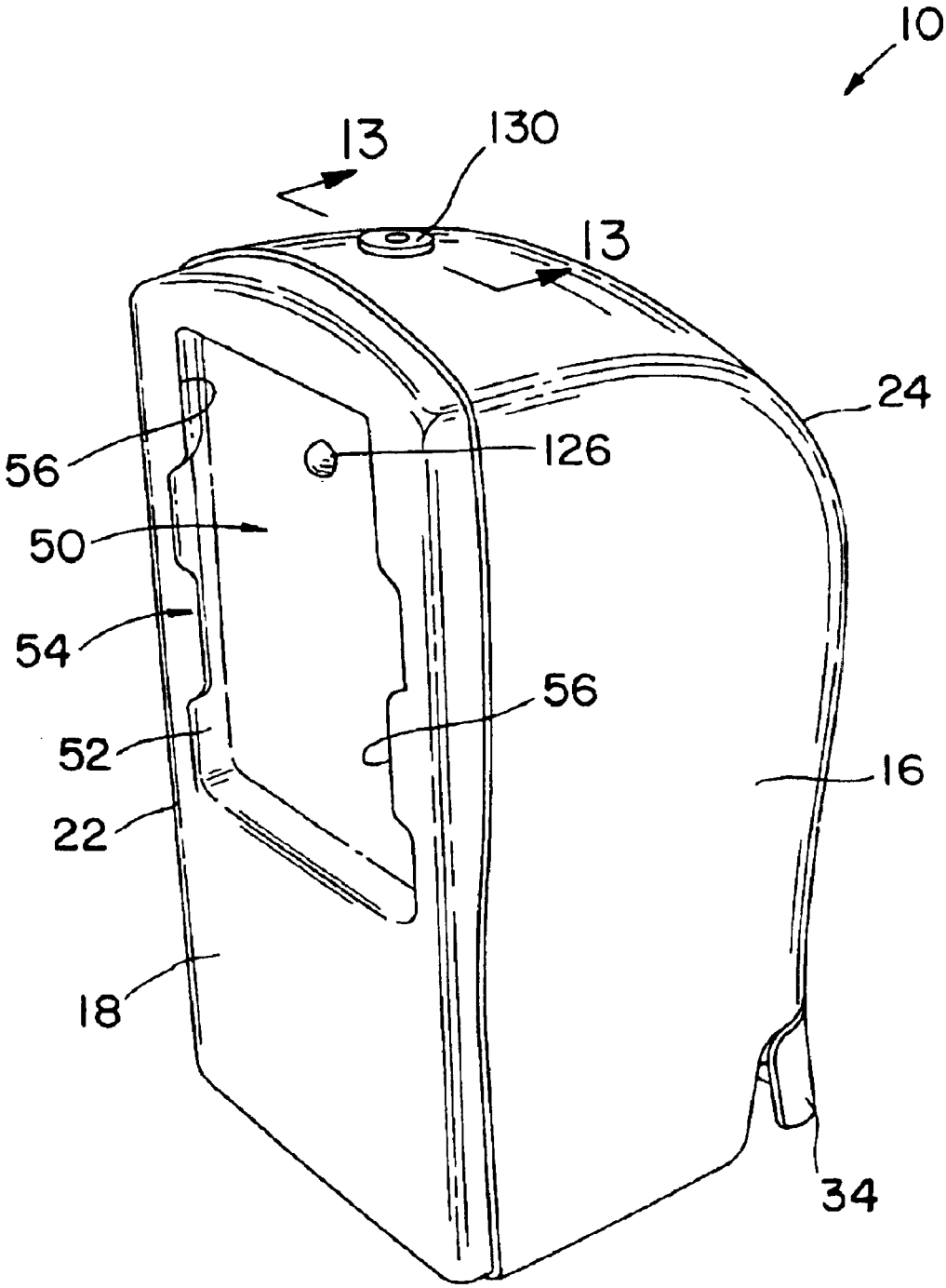
FIG. 2 is a perspective view of the back side of the dispenser illustrated in FIG. 1.

Reference will now be made in detail to embodiments of the invention, one or more examples of which are illustrated in the drawings. Each example is provided by way of explanation of the invention, not meant as a limitation of the invention. For example, features illustrated or described as part of one embodiment, may be used with another embodiment, to yield still a further embodiment. It is intended that the present invention include modifications and variations to the embodiments described herein.

A viscous liquid dispenser 10 according to the invention is illustrated generally in the figures. The dispenser 10 is illustrated and described herein as a liquid soap dispenser, which is a particularly useful embodiment of the present invention. However, it should be appreciated that the present invention is not limited to a dispenser for liquid soap, but has application in any environment wherein it is desired to dispense a metered amount of a viscous liquid from a dispensing unit.

Figure 4:
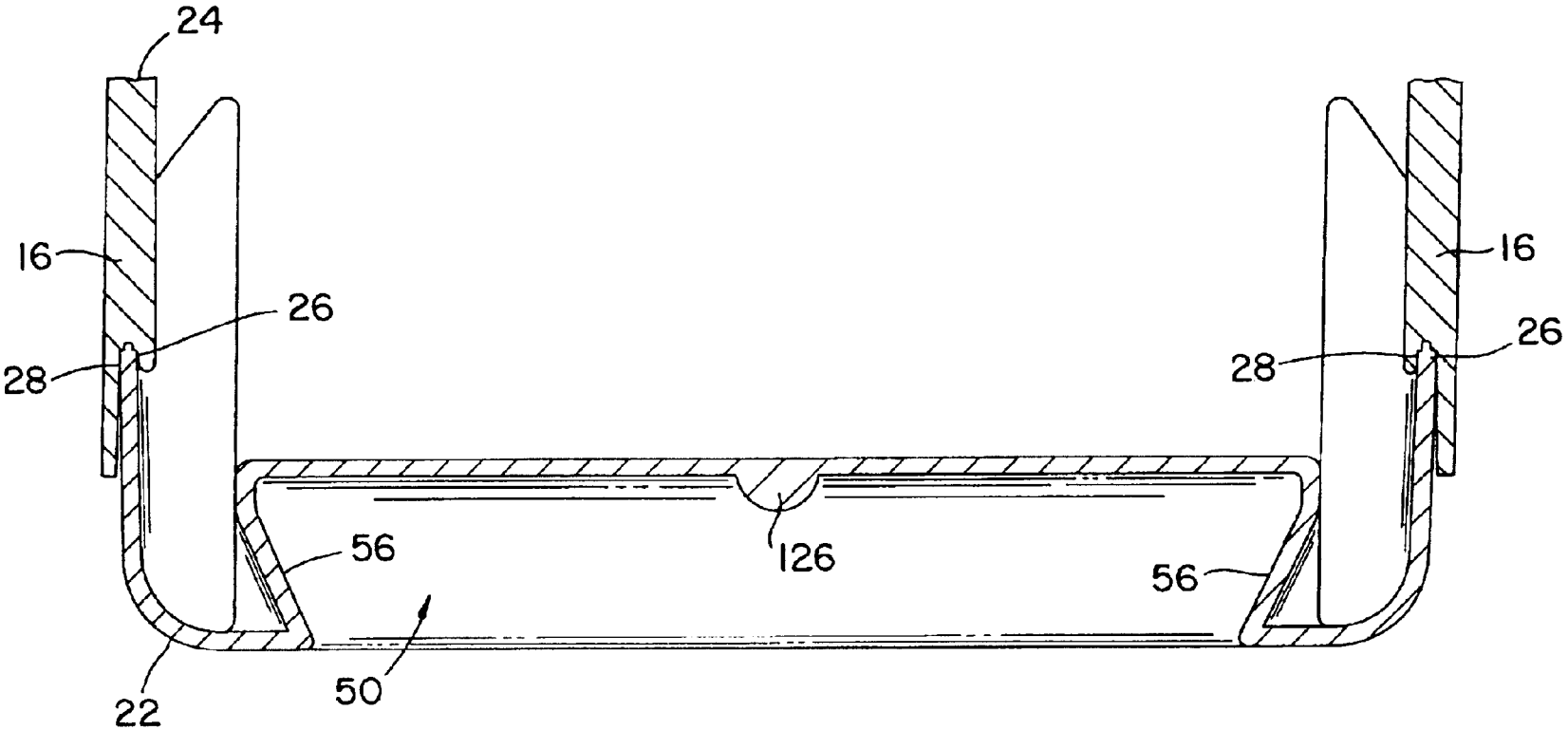
FIG. 4 is a cross-sectional view of the dispenser taken along the lines indicated in FIG. 3.
Figure 10:
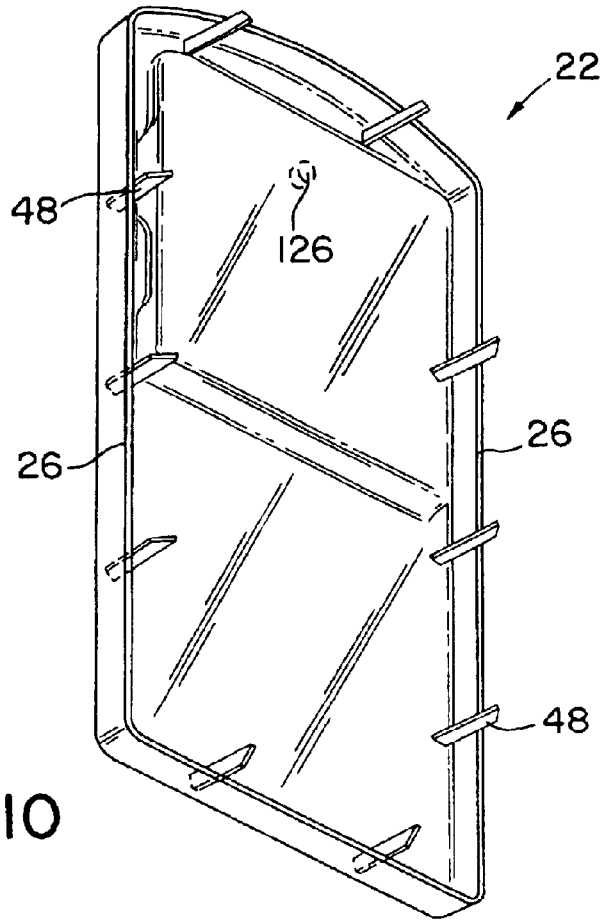
FIG. 10 is a perspective view of a back component of the dispenser housing.

The dispenser 10 includes a housing, generally 14. The housing 14 may contain side walls or members 16, a back side 18, and a front side 20. The housing 14 can take on any desired configuration and be formed from any number of components. In the illustrated embodiment, the housing 14 includes a front component 24 and a back component 22. The front and back components are separately manufactured and are permanently joined. It should be appreciated that the components may be manufactured from any desired material. In a preferred embodiment, the dispenser 10 is a disposable item and the housing 14 is molded from a relatively inexpensive plastic material. Referring particularly to FIG. 10, the back component 22 may be molded from a clear or translucent plastic and includes side edges 26 and alignment tabs 48. The tabs 48 align the back component 22 relative to the front component 24 and the side edges 26 fit into correspondingly sized recesses 28 (FIG. 4) defined in the side walls 16 of the front component 24. The back component 22 is permanently joined to the front component 24 by adhesives, welding, or any other relatively permanent attaching means.

The housing 14 defines an internal liquid reservoir 68 within the internal volume thereof. In the illustrated embodiment, the liquid reservoir 68 includes essentially the entire volume defined by the front component 24 and back component 22. Although not illustrated, it should be understood that any number of internal structural members, such as baffles or the like, may be included within the reservoir 68. It should be understood that the housing 14 thus also serves as a closed or sealed reservoir and the dispenser 10 cannot be opened by the maintenance technician. A desired amount of viscous liquid, for example soap, is preloaded into the dispenser 10 prior to the dispenser being delivered to its point of use.

Applicants have found that it may be desired for the back component 22 of the housing 24 to be more rigid than the front component 24. One way of achieving this feature is to simply mold the back component 22 with a thickness greater than that of the front component 24. As will be explained in greater detail below, the dispenser 10 is mounted onto a supporting wall surface by means of an internal mounting mechanism configured on the back side 18 of the housing 14. A more rigid back component 22 aids in mounting the dispenser 10. It has also been found that, if the front and back components are molded from a resilient plastic material, once the dispenser is empty, the back component 22 has enough "give" to enable the dispenser 10 to be easily removed from the supporting wall structure.

A dispensing pump mechanism, generally 88, is disposed at least partially within the reservoir 68. The pump mechanism 88 has a delivery end 90 that extends out of the housing or reservoir 68. The pump mechanism 88 is configured to dispense a metered amount of the viscous fluid upon a user actuating the pump mechanism. It should be appreciated that any number of conventional and well known pump devices may be utilized in the dispenser 10. The pump mechanism 88 illustrated in the drawings is one embodiment of a particularly well suited mechanism.

Figure 5:
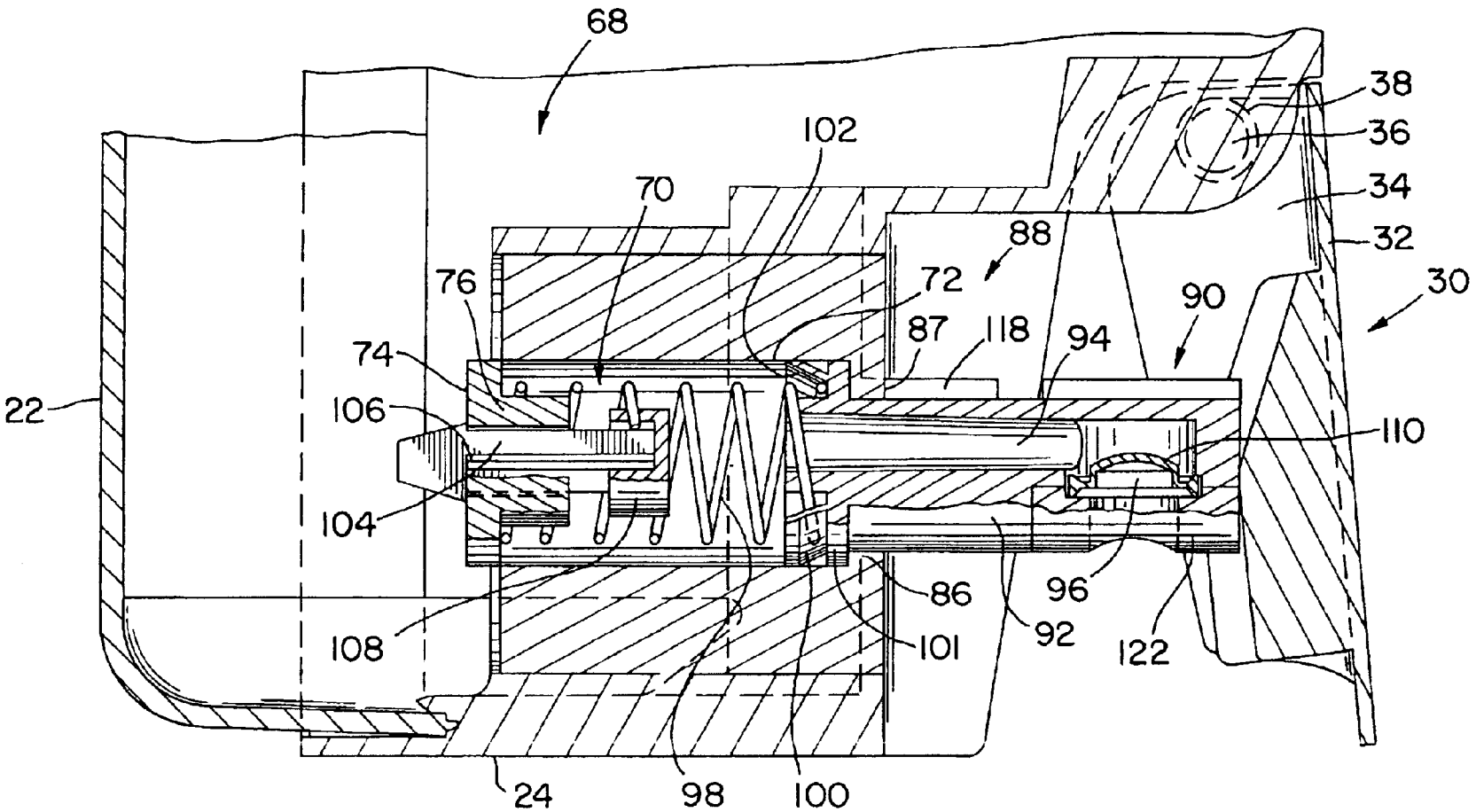
FIG. 5 is a cross-sectional view of the pump mechanism of the dispenser taken along the lines indicated in FIG. 3.
Figure 6:
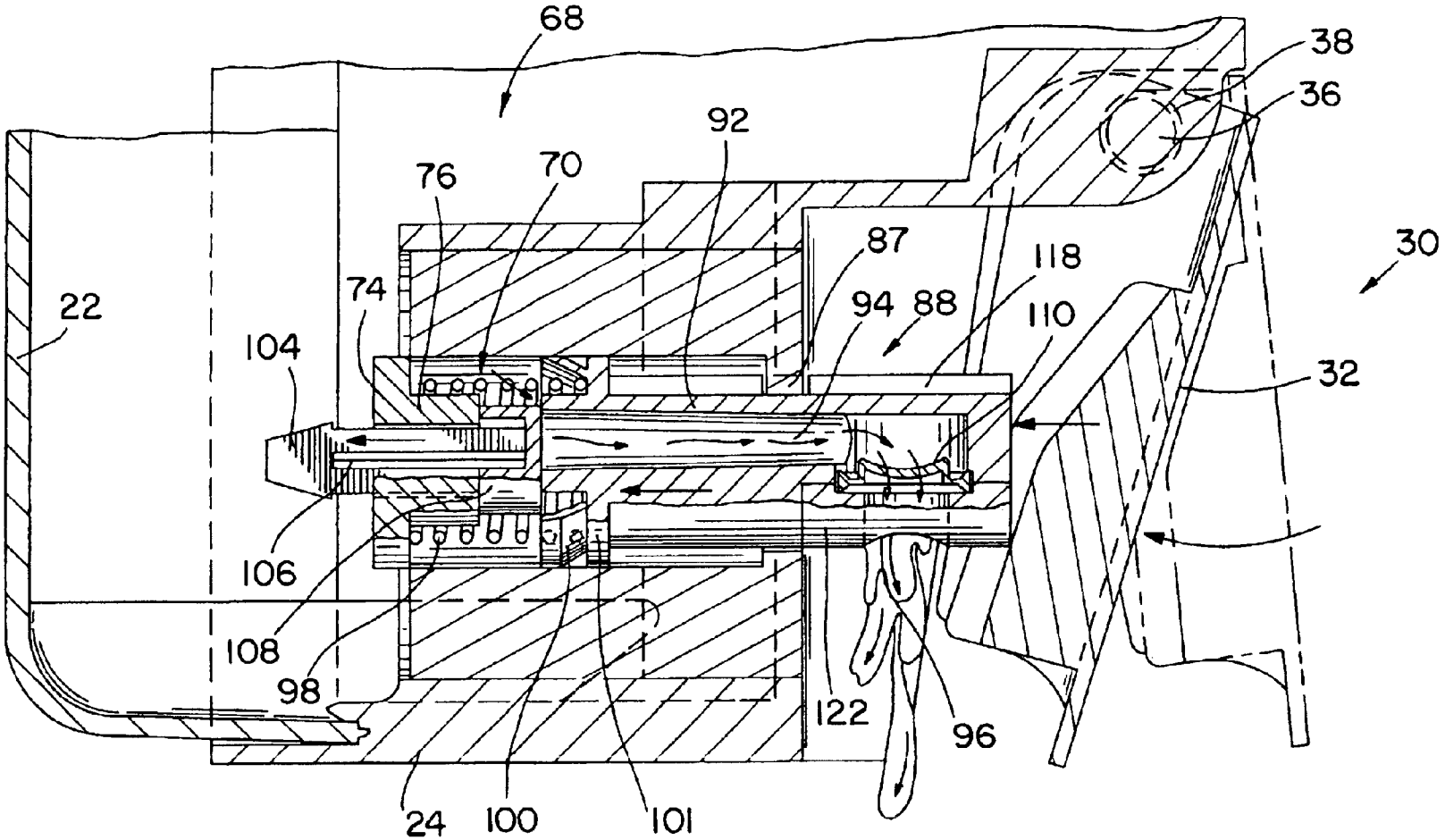
FIG. 6 is a cross-sectional operational view of the pump mechanism.
Figure 7:
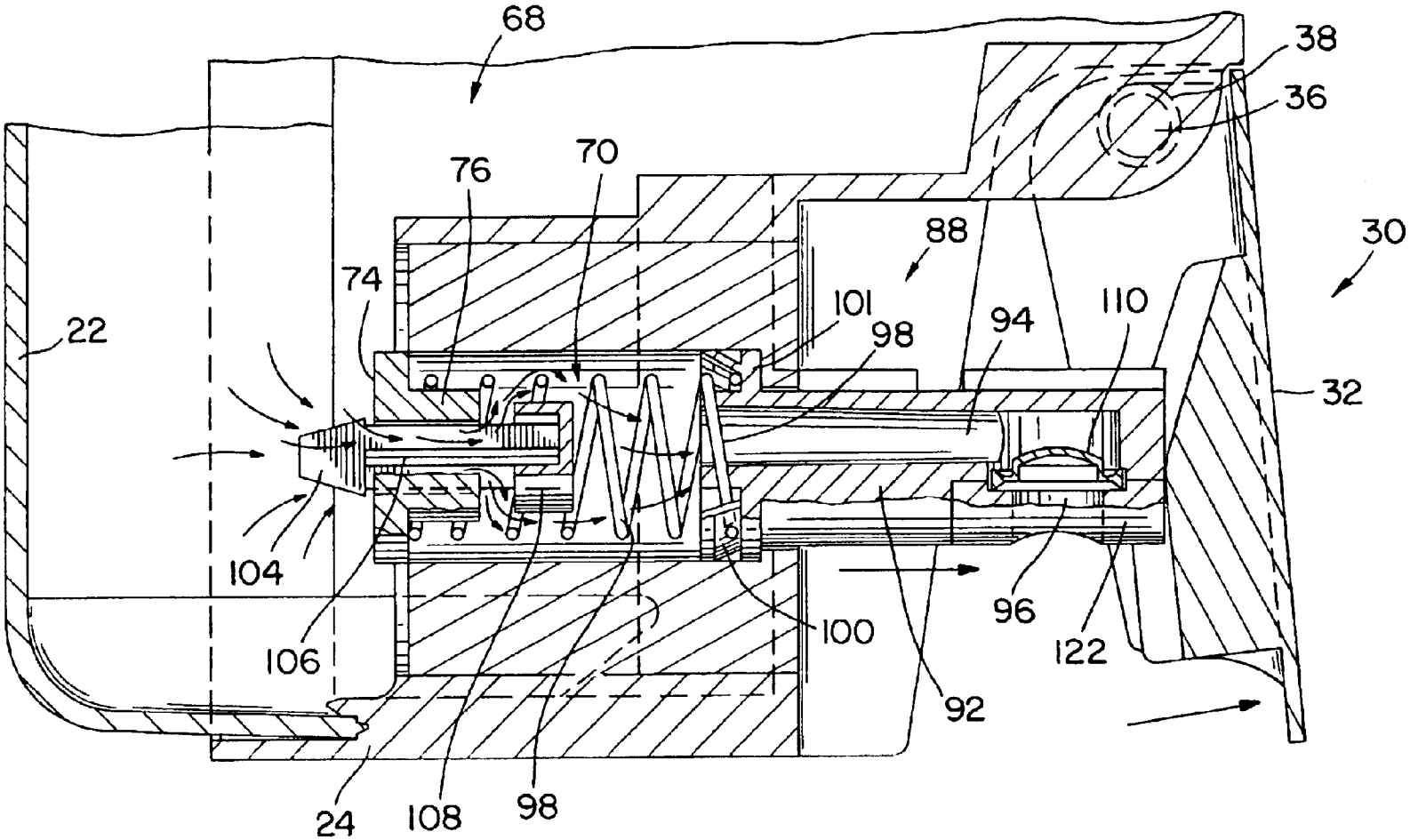
FIG. 7 is a cross-sectional operational view of the pump mechanism.

Referring to FIGS. 5 through 7, the pump mechanism 88 includes a cylinder 92 that is slidable within a chamber 70. The volume of chamber 70 determines the metered dose of liquid dispensed upon each actuation of the pump. The chamber 70 may be formed by any internal structure of the housing 14. It may be preferred that the chamber is defined by structure integrally molded with the front component 24 of the housing 14. In the illustrated embodiment, the chamber 70 is defined by chamber walls 72 as a generally cylindrical chamber. The cylinder 92 includes a channel 94 defined longitudinally therethrough. The channel 94 is in communication with the interior of the pump chamber 70 through an end wall of the cylinder. The delivery channel 94 terminates at a dispensing orifice 96 defined in the front end of the cylinder 92.

The cylinder 92 sealingly engages against the chamber walls 72 by any conventional means. For example, a flange or piston 101 may be disposed at the rear end of the cylinder 92 for sealing engagement against chamber wall 72. In an alternative embodiment, O-rings 116 (FIG. 8*a*) may be provided around the piston 101. The piston 101 pressurizes the chamber 70 and ensures that the viscous liquid contained within the chamber is dispensed through the delivery channel 94 upon actuation of the cylinder 92 and does not simply move from one end of the pump chamber 70 to the other upon movement of the cylinder.

The pump cylinder 92 is biased within the chamber 70 by way of, for example, a spring 98. Other resilient devices, including a leaf spring, spring washer, and the like, may be utilized for this purpose. In the illustrated embodiment, the spring 92 is seated within a recess 102 defined by a flared flange 100, as particularly illustrated in FIGS. 5 through 7. The opposite end of the spring 98 is fitted around a cylindrical extension 76 of an end cap 74. The end cap 74 is permanently fixed to the structure defining the pump chamber 70 after the cylinder 92 has been inserted into the pump chamber.

Structure is also provided to ensure that the cylinder 92 cannot be pulled from the front end of the chamber 70. In the illustrated embodiment, this structure corresponds to a flange portion of the front wall 86 of the chamber 70. As illustrated in FIG. 5, the flange portion 86 of the wall engages against the piston 101 of the pump cylinder 92.

A check valve device 104 is configured with the pump mechanism 88 to ensure that the viscous liquid within the pump chamber 70 is not pushed out of the chamber 70 upon movement of the cylinder 92 within the chamber 70. In the illustrated embodiment, the check valve device 104 is a shuttle type check valve having radially extending arms 106. The shuttle valve is slidably disposed within an opening defined through the end cap 74. The space between the radial arms 106 is open to the reservoir 68 so that the liquid can flow from the reservoir 68 into the pump chamber 70 upon movement of the cylinder to the forward end of the pump chamber 70, as illustrated in FIG. 7. A cap 108 is provided on the forward end of the shuttle valve 104 disposed within the pump chamber 70 to ensure that the opening in the end cap 74 is sealed upon actuation of the pump. The cap 108 seals against the end face of the end cap 74.

Operation of the pump mechanism 88 is particularly illustrated in FIGS. 6 and 7. To dispense a metered amount of the viscous liquid contained within the reservoir 68, a user actuates the pump mechanism 88 by way of an actuator 30. The actuator 30 will be described in greater detail below. Upon depressing the actuator 30, the pump cylinder 92 is moved rearward within the pump chamber 70. Pressure of the viscous liquid within the chamber 70 forces the shuttle valve 104 to close and the viscous liquid contained within the chamber 70 is directed into the delivery channel 94 defined longitudinally within the pump cylinder 92. The viscous liquid is expelled through the dispensing orifice 96, as particularly illustrated in FIG. 6. Upon release of the actuator 30, the spring 98 forces the pump cylinder to return to the position illustrated in FIG. 7. This action unseats the shuttle valve 104 and draws viscous liquid back into the pump chamber 70, as particularly illustrated in FIG. 7.

Figure 13:
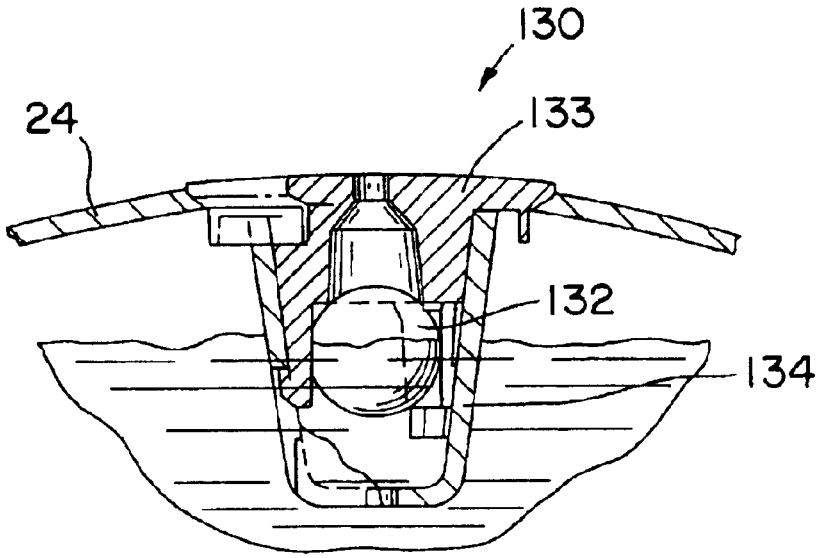
FIG. 13 is a cross-sectional view of the vent valve taken along the lines indicated in FIG. 2.

So as not to draw a vacuum within the reservoir 68, the reservoir is vented. This venting may be accomplished by various means. For example, the reservoir 68 could be vented directly through or around the cylinder 92. However, this may not be a desired embodiment since fluid would tend to leak out from around the cylinder. One preferred venting method as illustrated in the figures is to vent the top of the housing 14, for example by way of a conventional vent valve 130 disposed through the top surface of the housing 14. The vent valve 130 is particularly illustrated in FIG. 13 and utilizes a ball 132 seated within a ball cage 134. The ball 132 seats against and seals an opening provided in a top member 133 upon an overfill condition of the viscous liquid, as illustrated in FIG. 13, or upon the housing 14 being overturned during shipment or the like. Once the dispenser is hung on a wall surface for subsequent use, the ball 132 falls within the ball cage 134 to open the vent valve 130. Sealing of the ball 132 may further be assisted by a spring.

Figure 14:
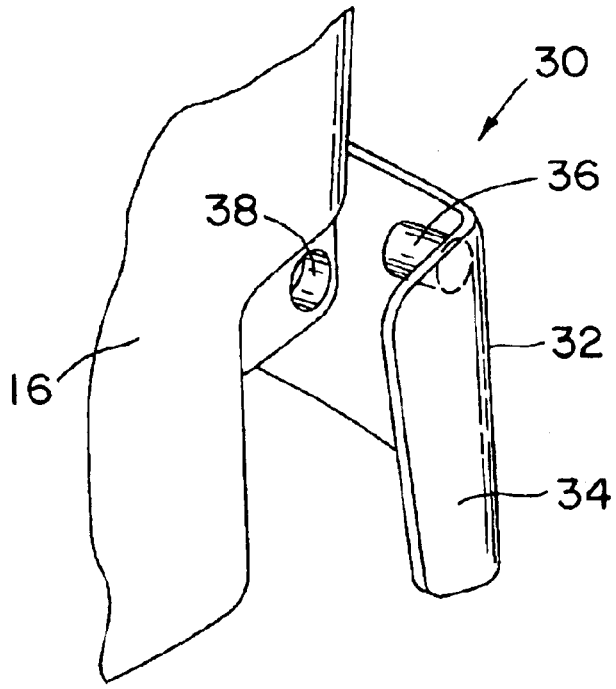
FIG. 14 is a an enlarged perspective view of the panel member actuator attached to the pump housing.

As mentioned, the pump mechanism 88 is operated by a user depressing an actuator 30. The actuator 30 may be any member configured to move the pump cylinder 92. In one embodiment illustrated in the figures, the actuator 30 is defined by a panel member 32 that adds a distinctive aesthetically pleasing look to the housing 14. The panel member 32 includes side walls 34 having inwardly disposed protrusions 36 (FIG. 14) that engage within correspondingly sized divots or recesses 38 provided in the sides 16 of the housing 14. A channel member 40 (FIG. 3) may be provided on the inner face of panel member 32 to positively engage against the front end of the pump cylinder 92. A depression 33 may be defined in the front face of panel member 32 to indicate to a user the proper location for depressing the actuator.

Figure 15:
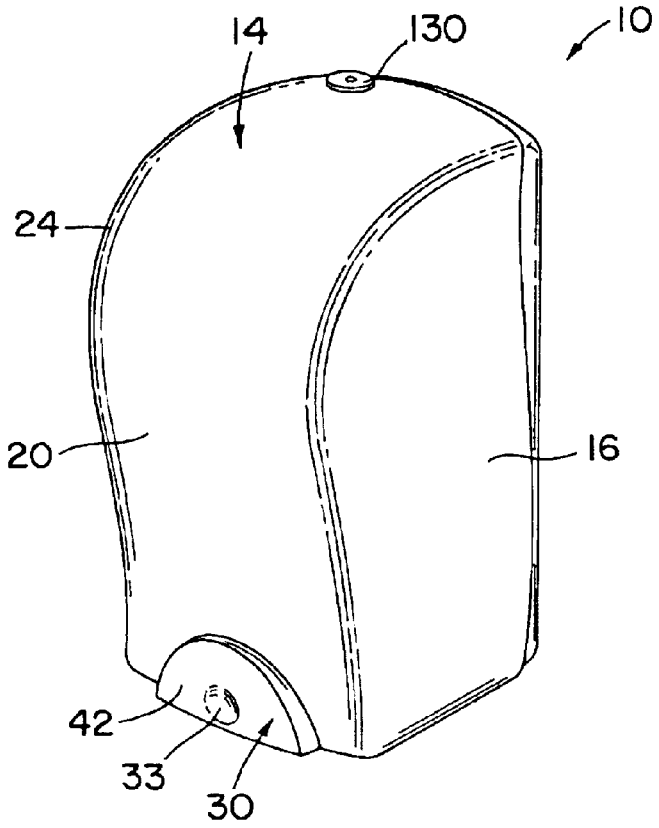
FIG. 15 is a perspective view of an alternative embodiment of the dispenser.
Figure 16:
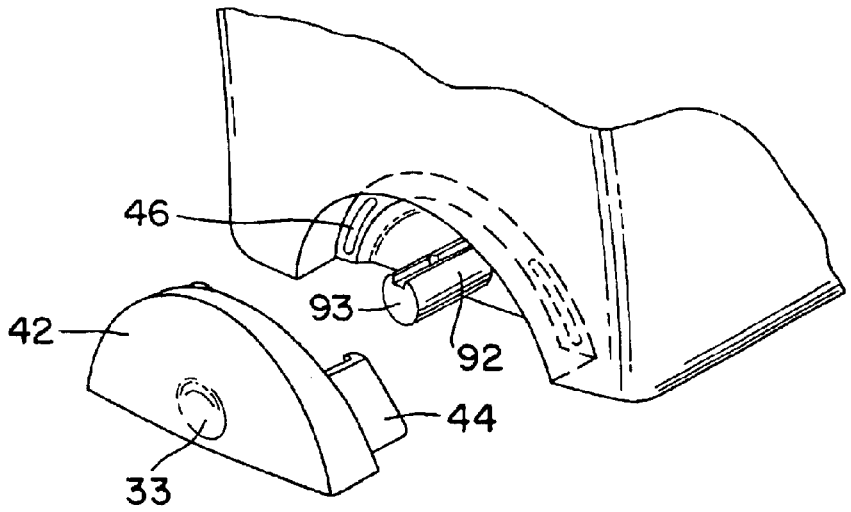
FIG. 16 is an enlarged component view of the actuator used with the dispenser illustrated in FIG. 15.
Figure 17:
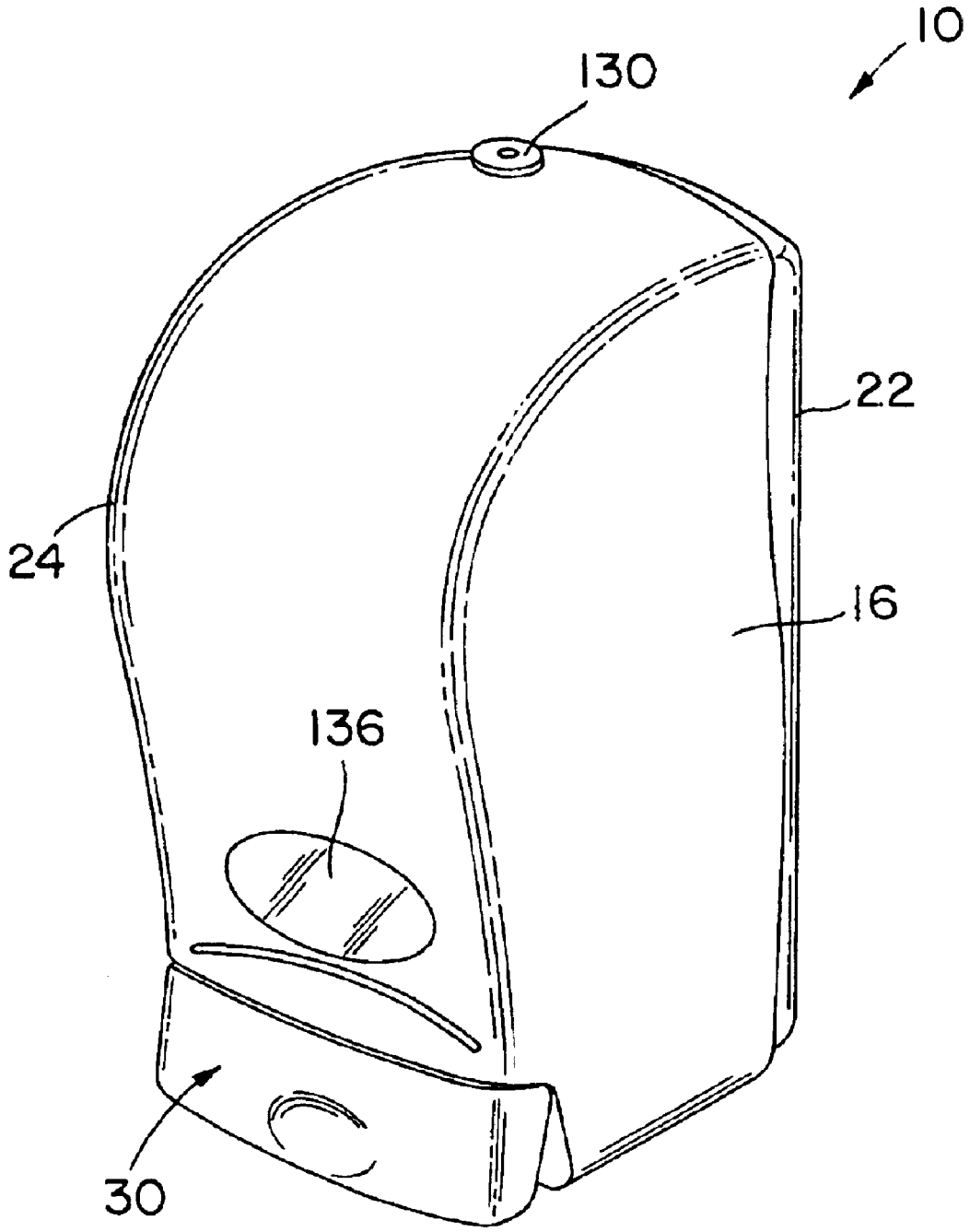
FIG. 17 is a perspective view of an alternative embodiment of the dispenser particularly illustrating a window feature for determining the level of liquid within the dispenser.

It should be appreciated that the actuator may take on any configuration or aesthetically pleasing shape. In an alternate embodiment illustrated particularly in FIGS. 15 and 16, the actuator 30 is defined by a cap 42 that is attached directly to the front face 93 of the pump cylinder 92. This attachment may be provided by adhesives, mechanical interlocking devices, or the like. Arms 44 may slidably engage within recesses 46 defined in the pump housing 14 to ensure proper alignment and to provide rigidity to the structure.

Figure 8A:
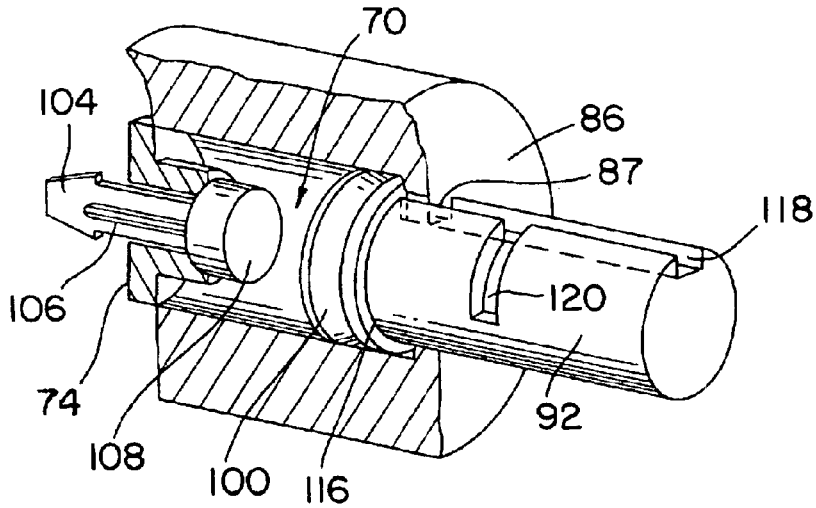
FIG. 8*a* is partial perspective and cut-away view of the pump mechanism particularly illustrating the check valve device.
Figure 8B:
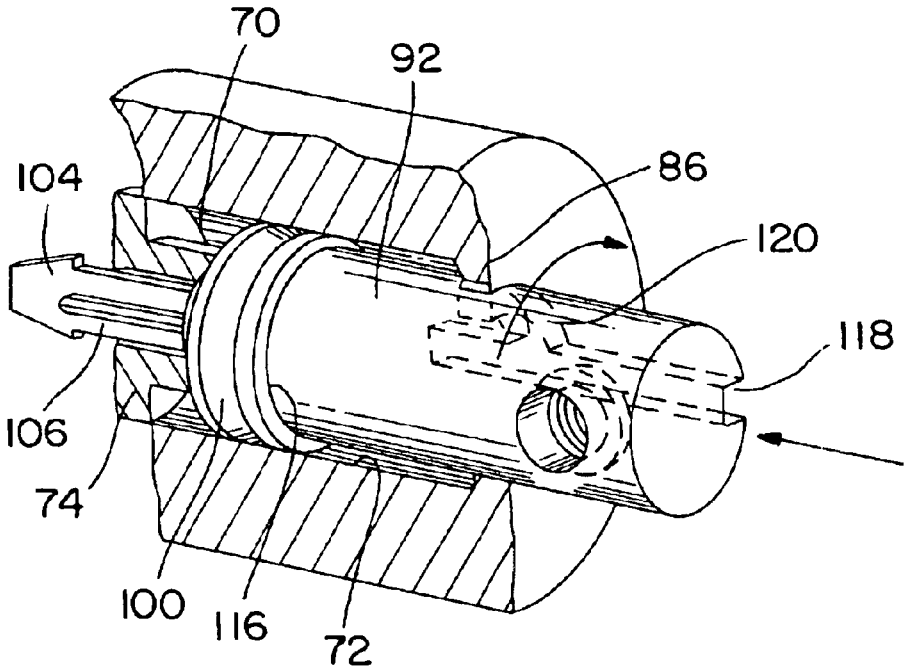
FIG. 8*b* is a partial perspective and cut-away view of the pump mechanism particularly illustrating the locking feature thereof.

FIGS. 8*a* and 8*b* illustrate a locking characteristic of the pump cylinder 92 that is particularly useful during shipment of the dispensers 10. The pump cylinder 92 may include a longitudinal channel 118 defined in the top thereof.

A tab portion 87 of the pump chamber front wall member 86 is disposed within the longitudinal channel 118. In this way, the pump cylinder 92 is prevented from rotating upon actuation and release thereof. A partial circumferential channel 120 is defined in the pump cylinder 92, as particularly illustrated in FIG. 8*a*. The circumferential channel 120 is defined along the pump cylinder 92 at a location corresponding to the completely depressed or actuated position of the cylinder 92 within the chamber 70, as illustrated in FIG. 6. For shipment of the dispensers 10, the pump cylinder 92 may be depressed and then rotated so that the tab 87 is engaged within the circumferential channel 120, as particularly illustrated in FIG. 8*b*. In this configuration, the pump cylinder 92 is locked in position and cannot move within the chamber 70 until the pump cylinder is rotated back into the position illustrated in FIG. 8*a*. This procedure would be accomplished by the maintenance technician prior to attaching the actuator 30 and mounting the dispenser 10 onto a supporting wall surface.

It may be desired to include a valve mechanism within the dispensing orifice 96 of the pump cylinder 92 to prevent leakage of viscous liquid or soap from the dispenser. Any manner of sealing valve may be utilized in this regard. Applicants have found that a particularly useful valve mechanism 110 is the type of valve illustrated in FIGS. 9*a* and 9*b*. This valve 110 includes a flange member 113 used to seat the valve 110 within the delivery and of the pump cylinder 92, as particularly illustrated in FIGS. 5 through 7. The valve includes at least one, and preferably a plurality, of resilient flaps 112 defining an opening 114 therethrough. The flaps 112 seal against themselves when the valve 110 is positioned within the pump cylinder 92 in the orientation illustrated in FIGS. 5 through 7. Upon actuation of the pump cylinder 92, liquid pressure forces the resilient flaps 112 to open to dispense the liquid from the pump cylinder 92, as particularly illustrated in FIG. 6. A separate cap member 122 may be used to secure the valve 110 in position with respect to the dispensing orifice 96, the cap member 122 includes its own opening aligned with the dispensing orifice. The cap member 122 may comprise a press fit element or may be permanently adhered, welded, etc., to the pump cylinder 92.

The valve 110 also tends to vent the pump chamber 70 as the cylinder 92 moves back to its rest position after being actuated. As a vacuum is drawn in the chamber 70, the resilient flaps separate slightly and are drawn towards the chamber 70 thus defining a vent path. Once the chamber is vented, the flaps close and seal against each other.

Figure 9A:
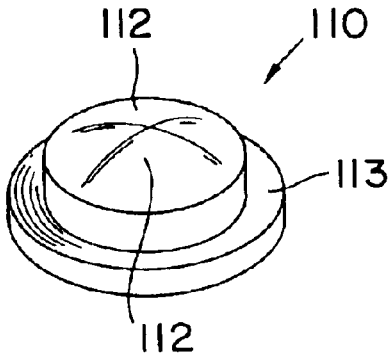
FIG. 9*a* is a perspective view of a valve mechanism incorporated in the pump cylinder.
Figure 9B:
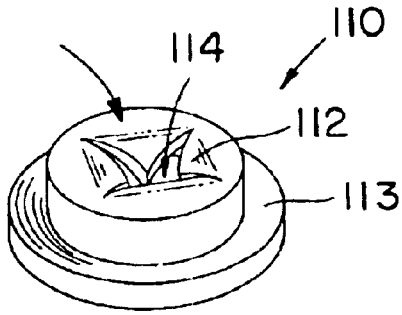
FIG. 9*b* is an operational perspective view of the valve mechanism of FIG. 9*a;*
Figure 11:
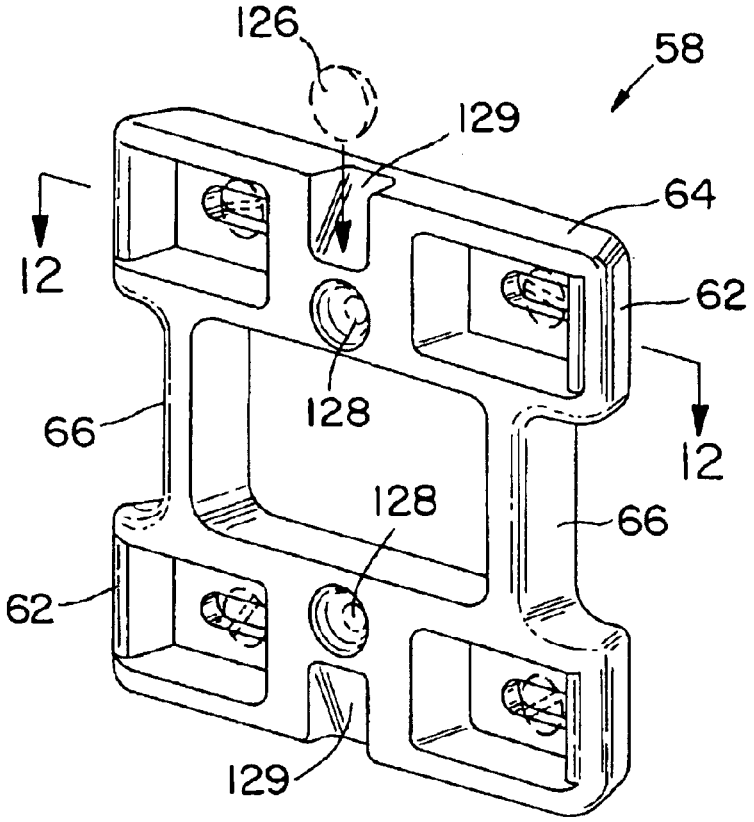
FIG. 11 is a perspective partial operational view of a wall mounting bracket for mounting the dispenser.

The valve 110 illustrated in FIGS. 9*a* and 9*b* is conventionally known in the art as a bifurcating valve and may be obtained from LMS Corporation of Michigan.

Figure 3:
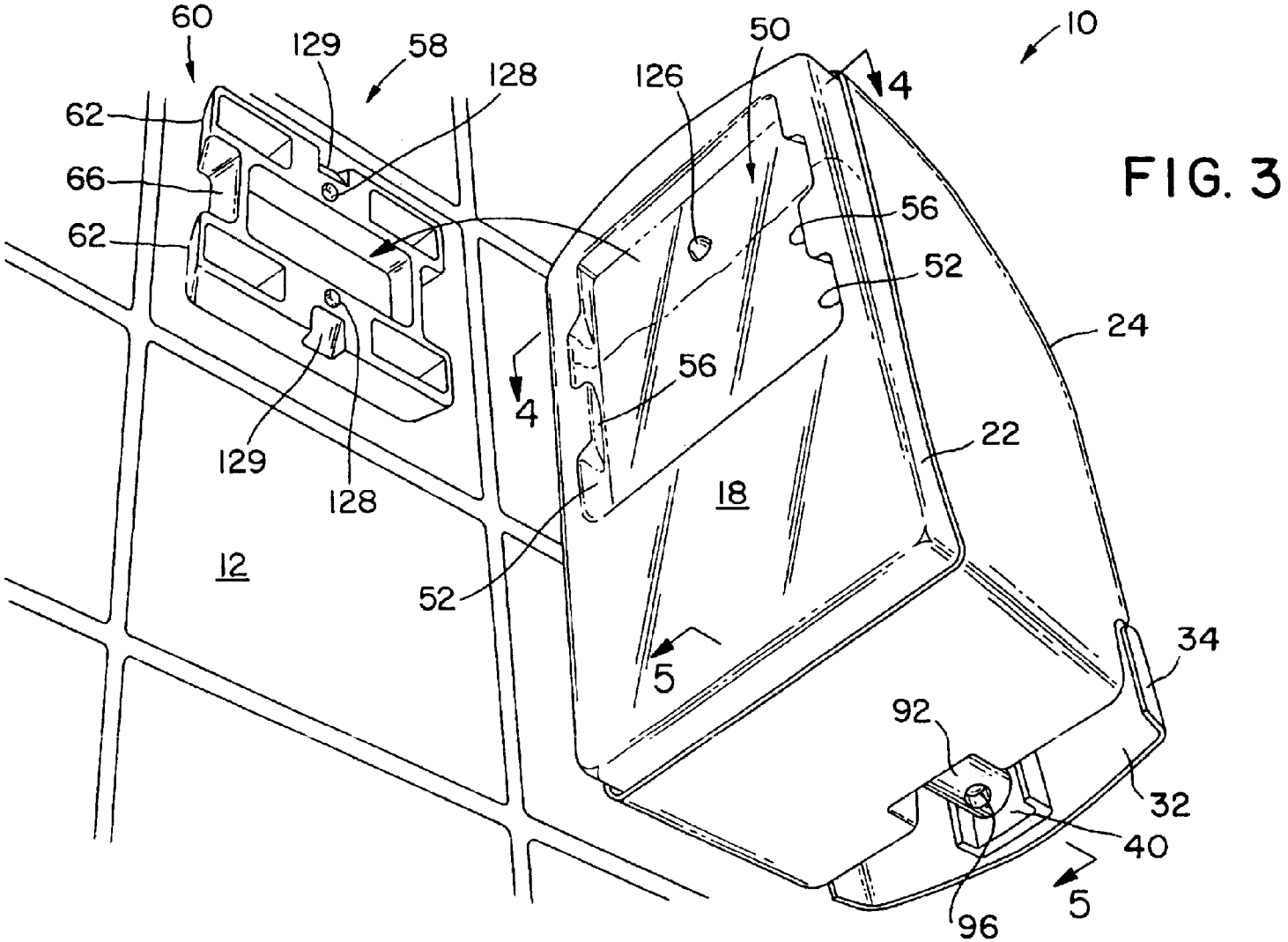
FIG. 3 is an alternative perspective view of the dispenser according to FIG. 1 and complimentary wall mounting structure.
Figure 12:
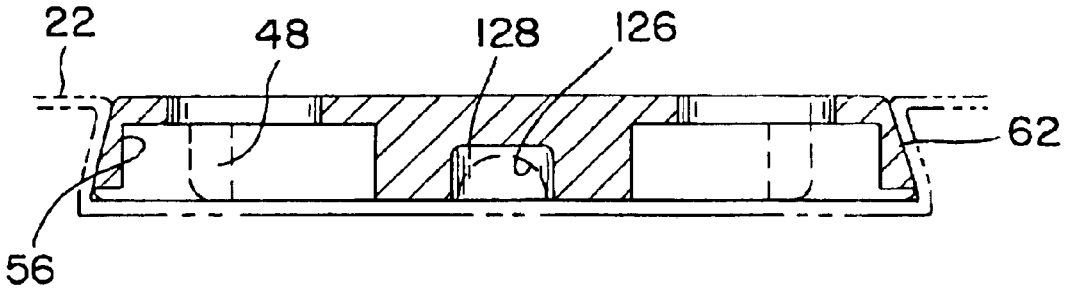
FIG. 12 is a cross-sectional view of the wall mounting bracket taken along the lines indicated in FIG. 11.

The dispenser 10 according to the invention also includes an integrally formed mounting mechanism configured as an integral component of the housing 14. This mounting mechanism allows the dispenser 10 to be detachably connected with complimentary mounting structure, generally 58, provided on a wall surface 12 (FIG. 3). In one embodiment according to the invention, the mounting mechanism is defined as an integrally molded feature of the back side 18 of the dispenser 10. In the illustrated embodiment, a recess 50 is molded into the back side 18. The recess 50 is defined by generally vertical side walls 52. Engaging structure is provided along the side walls 52 for engaging against or with complimentary structure provided on the wall mounting structure 58, as discussed in greater detail below. In the illustrated embodiment, the engaging structure is defined by angled surfaces 56 defined along the vertical walls 52. The angled surfaces 56 engage against complimentary angled surfaces 62 defined on the wall mounting structure 58, as can be particularly seen in FIGS. 3 and 12. In the illustrated embodiment, at least two angled surfaces 56 are provided and are separated by a section of vertical wall 52. The two angled surfaces 56 engage against angled surfaces 62 of the wall mounting structure 58. In order to attach the dispenser 10 to the wall mounting structure 58, the maintenance technician simply positions the dispenser 10 against the wall mounting structure 58 such that the angled surfaces 56 are vertically disposed between the corresponding angled surfaces 62 of the wall mounting structure. Then, the maintenance technician simply slides the dispenser 10 in a vertical direction so that the angled surfaces 56, 62 engage, as particularly illustrated in FIG. 12. In this interlocking configuration, the dispenser cannot be pulled away from the wall mounting structure 58. The double angled surface 56 configuration provided on each vertical wall 52 is particularly useful in that it provides an increased interlocking surface area of angled surfaces with relatively little vertical movement required between the dispenser 10 and the wall mounting structure 58 as compared to a single angled surface 56 having the same longitudinal surface area.

Once the dispenser 10 has been properly located on the wall mounting structure 58, it is desirable to include a securing device to indicate to the technician that the dispenser 10 has been properly positioned and to prevent removal of the dispenser 10 without a concerted effort. In the embodiment illustrated, the securing device comprises a protrusion 126 extending from the back side 18 of the housing within the recess 50. The protrusion 126 slides up a ramp surface 129 defined in the mounting structure 58 and snaps into a correspondingly sized divot 128 disposed adjacent to the ramp surface 129. The wall mounting structure 58 may comprise any manner of suitable attaching structure. In the illustrated embodiment, the wall mounting structure 58 is defined by a plate member 64 that is attached to the wall surface 12, for example by screws, adhesives, or the like. The wall mounting structure 58 serves simply to provide an interlocking engagement device for the dispenser 10. It should be appreciated that any manner of interlocking engaging configurations may be provided for detachably connecting the dispenser 10 to complimentary wall structure provided on a supporting wall. For example, relatively simple bayonet type fasteners, spring loaded latches, and the like, may be provided in this regard. A desirable feature of the invention is that the entire dispenser 10 is disposable and, thus, relatively simple yet reliable engagement devices preferred. It has been found that the double angled surface configuration as illustrated and described herein is particularly useful in this regard.

Figure 19:
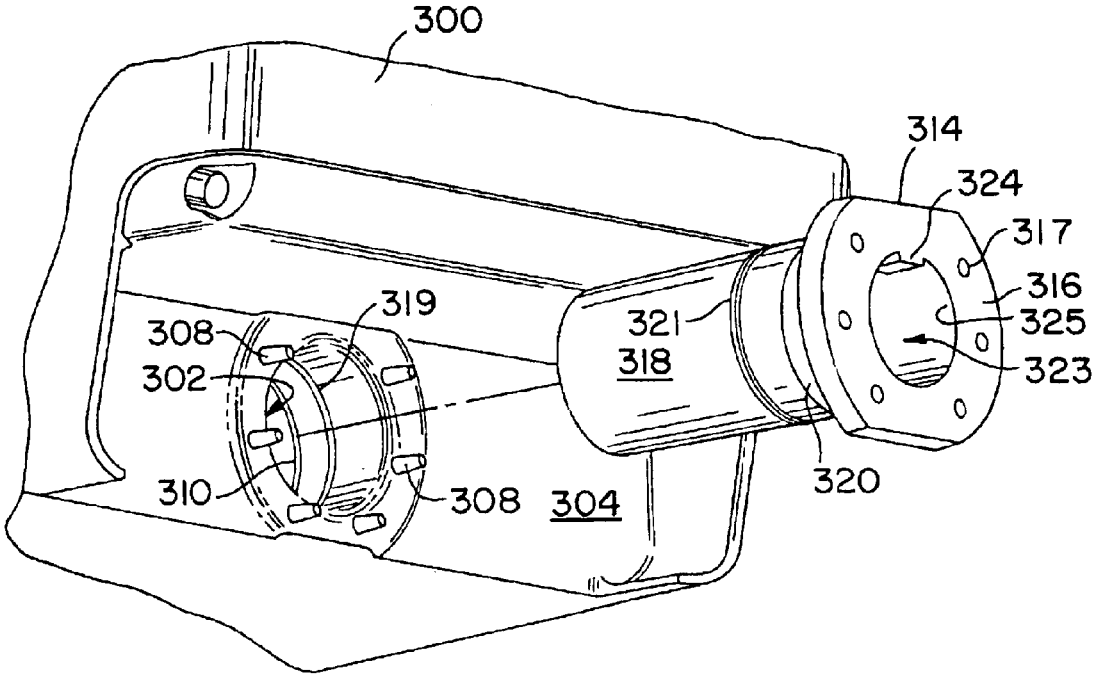
FIG. 19 is a perspective partial component view of the pump mechanism embodiment of FIG. 18.
Figure 20:
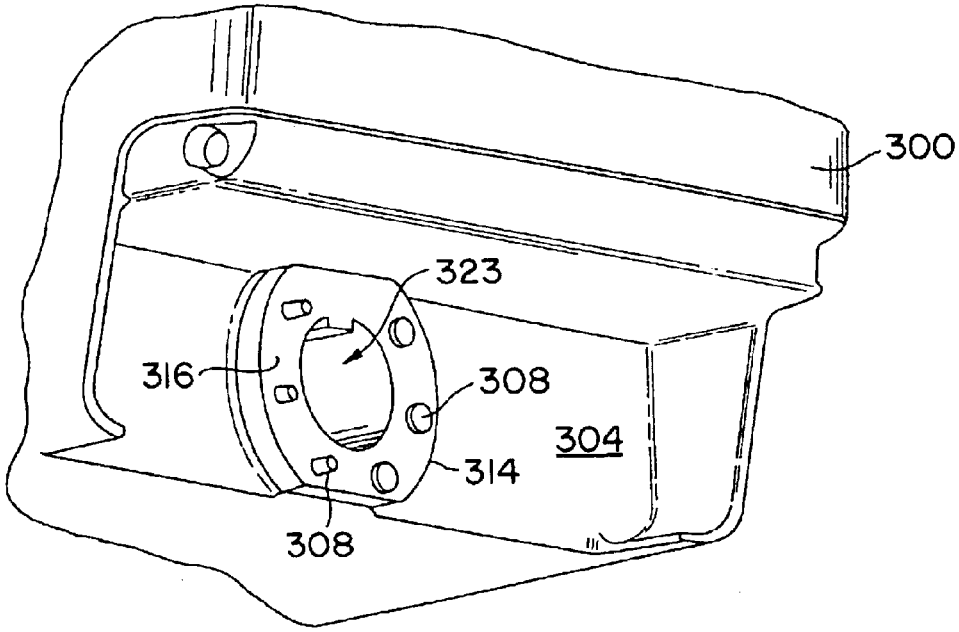
FIG. 20 is perspective partial assembled view of the components shown in FIG. 19.
Figure 21:
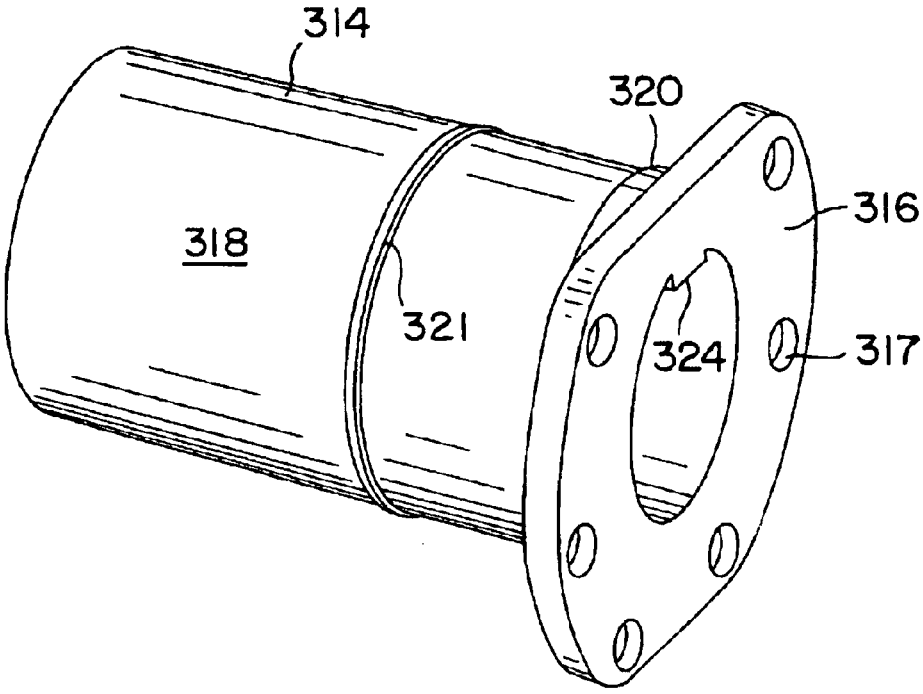
FIG. 21 is a perspective view of the pump chamber insert of the embodiment of FIG. 18.

It may also be desired to provide means for the maintenance technician to determine the level of viscous liquid within the dispenser. In this regard, as discussed above, a portion of the housing 14 may be formed from a translucent or clear material. In the embodiment illustrated particularly in FIG. 1, the entire back component 22 is formed from a translucent or clear material so that the service or maintenance technician can view the remaining liquid level from the side of the dispenser. In an alternative embodiment illustrated in FIG. 19, a window 136 of clear or translucent material may be provide anywhere in the housing 14, preferably near the bottom portion of the housing, to provide the maintenance technician with the capability of viewing inside the reservoir to determine the remaining amount of liquid therein.

As previously mentioned, a suitable pump mechanism for use in a dispenser according to the invention may include a self-contained device having a pump chamber housing that is fitted into a bore defined through a front wall surface of the housing so as to be in communication with the internal reservoir. Such an embodiment is illustrated in FIGS. 18 through 22. This embodiment is similar in many aspects to the embodiment of FIGS. 5 through 9 and, thus, the common features need not be described in detail.

Referring to FIGS. 18 through 22, in this embodiment the housing 300 includes a bore 302 defined through a front surface 304. A generally cylindrical extension 312 may extend rearwardly from the front surface 304 into the reservoir. The extreme end of the cylinder extension 312 has a radially inward extending seal 310. As will be described in greater detail below, seal 310 seals against a chamber insert member. A circumferential recess or groove 319 may also be defined in the extension 312. A plurality of nubs or protrusions 308 extend from the front surface 304 and surround the bore 302. The cylindrical extension 312, ring seal 310, groove 319, and protrusions 308 may all be molded integrally with housing 300.

A chamber insert 314 is designed to fit through the bore 302. The insert 314 is shown particularly in FIGS. 19 and 21 and may be a generally cylindrical member having an interior wall 325 defining an internal pump chamber 322. An opening 323 is defined through the forward end of the insert 314 through which a pump cylinder slides, as described below. The insert 314 includes a front outer flange 316 having a plurality of counter-bored holes 317 defined therethrough. The holes 317 align with the protrusions 308. The insert 314 is fitted through the bore 302 from the front side of the housing 300. The back side of the flange 316 is pressed against the front surface 304 of the housing 300 and the protrusions 308 extend through the holes 317. The insert is permanently attached to the housing 300 by melting the protrusions 308 in a "heat stake" process so that the molten material flows into the counter-bored holes 317 and thus anchors the insert 314 upon hardening, as particularly shown by the right-hand protrusions in FIG. 20. It should be appreciated that many other suitable devices and methods could be used to anchor or secure the insert 314 relative to the housing 300, including adhesives, welding, etc.

The insert 314 has an outer circumferential surface 318 that, when slid through the bore 302 and cylindrical extension 312, is tightly engaged by the seal 310 at the end of the extension 312. Thus, a first seal between the insert 314 and housing 24 is formed in this way. A ring-like protrusion 321 may be formed or otherwise provided around the surface 318 which engages in the groove 319 to give a positive indication that the insert 314 has been properly inserted. The ring 321 may be an O-ring and thus also provide a sealing capacity.

The insert 314 includes a radially outward extending portion 320 defined rearward of the back side of the outer flange 316. This portion 320 acts as a seal against the cylindrical extension 312, as particularly seen in FIG. 18. Thus, a second seal between the insert 314 and housing 24 is formed in this way.

The insert 314 includes an inner flange 326 defining the diameter of the opening 323, and an alignment tab 324 formed in the chamber 322. This tab 324 cooperates with a longitudinally extending channel or groove defined in the pump cylinder, as described below.

Figure 18:
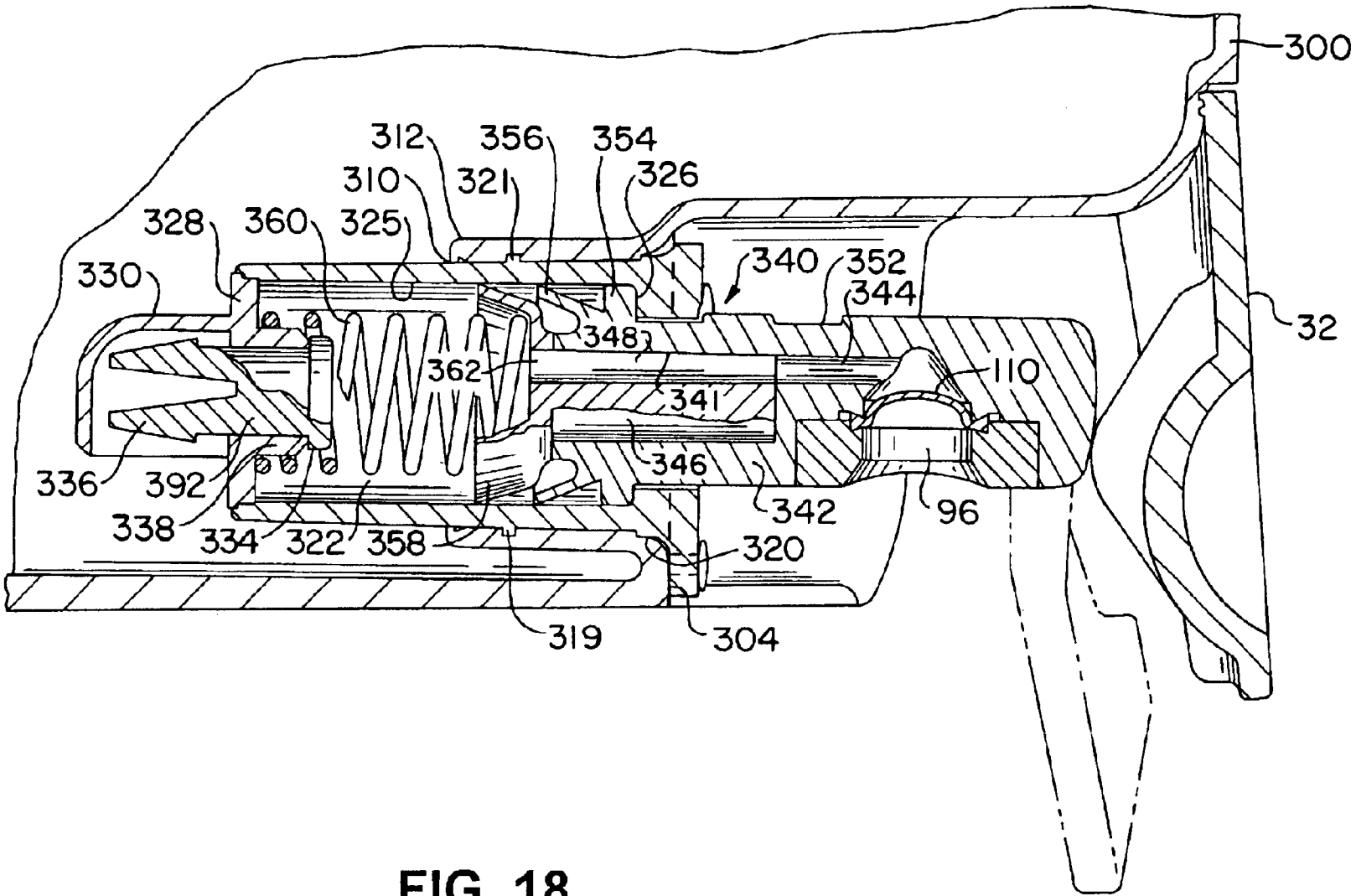
FIG. 18 is a cross-sectional view of an alternate embodiment of a pump mechanism according to the invention.
Figure 22:
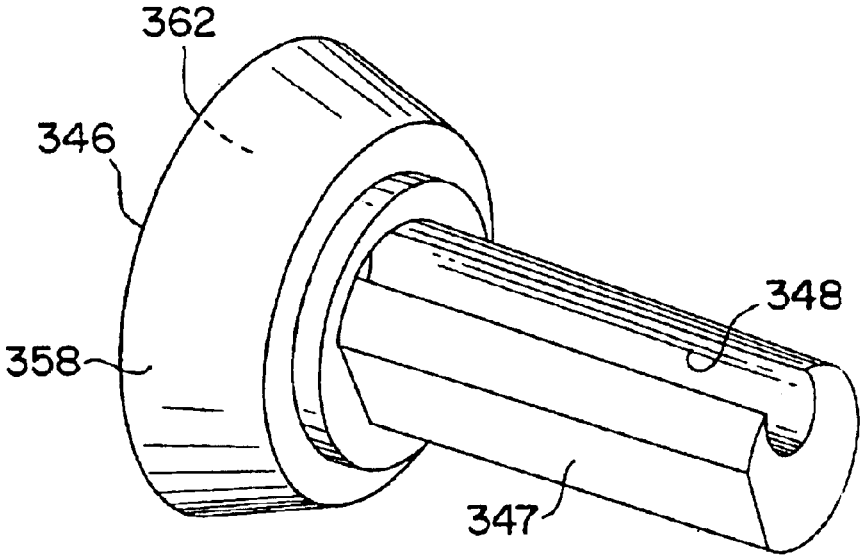
FIG. 22 is a perspective view of a component of the pump cylinder of the embodiment of FIG. 18.

An alternate embodiment of pump cylinder is disclosed in FIGS. 18 and 22. This pump cylinder embodiment may be used in the integrally molded pump chamber illustrated in FIGS. 5 through 9 or with the pump chamber insert 314. This embodiment includes a two-part pump cylinder 340. The first component 342 is a generally cylindrical member having a channel 344 defined therethrough that terminates at a dispensing orifice 96 defined in the front end of the first component 342. The front end of the first component 342 thus corresponds to the delivery end of the pump cylinder 340. A flange 354 is provided at the rearward end of the first component 342 to prevent the pump cylinder 340 from being pulled out of the pump chamber 322. This flange 354 engages against the inner flange 326 of the insert 314 in the fully extended position of the pump cylinder 340, as illustrated in FIG. 18.

As with the embodiment of FIGS. 5 through 9, a locking feature is provided for the pump cylinder 349. A longitudinal groove or channel (not visible in FIG. 18) is defined along the top outer surface of the first component 342 and is engaged by the alignment tab 324 of the insert 314 as the cylinder is slid longitudinally within the pump chamber 322. In this way, the pump cylinder 340 is prevented from rotating upon actuation and release thereof. A partial circumferential groove 352 is defined in the outer surface of the first component 342, as particularly illustrated in FIG. 18. The circumferential groove 352 is defined at a location corresponding to the pressurization position of the pump cylinder 340 within the pump chamber 322. For shipment of the dispenser, the pump cylinder 340 may be depressed and then rotated so that the tab 324 is engaged within the circumferential groove 352. In this configuration, the pump cylinder 340 is locked in the pressurization position and cannot move within the pump chamber 322 until the pump cylinder is rotated back into position so that the tab 324 is engaged within the longitudinal groove 350.

The first component 342 of the pump cylinder 340 also includes a flange seal 356 defined at the rearward end thereof. The flange seal 356 engages against the interior wall 325 of the insert 314 and ensures that the viscous liquid contained within the chamber 322 is pressurized and dispensed through the pump cylinder 340 upon movement of the cylinder from its rest position to the pressurization position and does not simply move from one end of the pump chamber to the other upon movement of the cylinder.

The second component of the pump cylinder 340 may be a plug member 346 having a generally cylindrical extension 347 that is fitted into a chamber 341 defined in the rearward end of the first component 342. The plug member 346 has a channel 348 defined therethrough that axially aligns with the channel 344 defined in the first component 342. The aligned channels 344 and 348 thus define the delivery channel through the pump cylinder 340. As shown in FIG. 22, the channel 348 may be open along the top thereof wherein a closed channel is formed by cooperation of the first component wall defining the chamber 341 and the open channel 348. A cup-shaped flange member 358 is defined at the rearward end of the plug member 346. The side wall of the flange member 358 engages against the interior wall 325 of the insert 314 and thus defines a second flange seal between the pump cylinder 340 and the pump chamber 322. The interior of the cup-shaped flange member 358 defines a recess or seat 362 against which a spring sits, as described below.

As with the embodiment of FIGS. 5 through 9, a check valve is provided with the pump chamber 322 to ensure that the viscous liquid within the chamber 322 is not pushed out of the chamber upon movement of the pump cylinder 340 within the chamber. The check valve in this embodiment is a shuttle valve 392 having radially extending and spaced apart arms 336. The shuttle valve 392 is slidably disposed within an opening defined through an end cap 328. The space between the radial arms 336 is open to the reservoir so that liquid can flow from the reservoir into the pump chamber 322 upon movement of the pump cylinder 340 to the forward end of the pump chamber 322. A sealing cap 334, such as an elastomeric cap, is provided on the forward end of the shuttle valve 392 to ensure that the opening in the end cap 328 is sealed upon actuation of the pump and rearward movement of the pump cylinder 340 within the chamber 322 to its pressurization position. The cap 334 seals against the forward end of a cylindrical extension 338 of the end cap 328. An open cage member 330 extends from the end cap 328 into the reservoir and surrounds the radial arms 336.

The pump cylinder 340 is biased with the pump chamber 322 to its rest position by way of a spring 360. Other types of resilient devices, such as a leaf spring, spring washer, and the like, may be utilized for this purpose. The spring 360 has a forward end seated in the recess 362 of the cup-shaped flange member 357 of the plug member 346. The opposite end of the spring 360 is fitted around the cylindrical extension 338 of the end cap 328.

The end cap 328 is permanently fixed (i.e., by welding, adhesive, etc.) to the rearward end of the chamber insert 314 after the pump cylinder 340 and spring 360 are inserted into the insert from its rearward end.

As with the embodiment of FIGS. 5 through 9, it may be desired to include a valve mechanism within the delivery end of the pump cylinder 340 to prevent leakage of viscous liquid from the dispenser. A particularly useful sealing valve is the type of valve illustrated and described with respect to FIGS. 9*a* and 9*b*.

Operation of the embodiment depicted in FIGS. 18 through 22 is substantially the same as described above with respect to the embodiment of FIGS. 5 through 9 and thus need not be set forth again in detail.

The pump mechanism of FIGS. 18 through 22 may be desirable from a manufacturing and assembly standpoint. It may also be desirable to be able to remove the pump mechanism from the housing and recycle or reuse all or part of the pump mechanism. In this case, it might be preferred to provide a more readily "breakable" or disconnectable attachment between the chamber insert 314 and the housing 24, such as a releasable adhesive, mechanical fastener (i.e., threaded connection), etc. Although within the scope and spirit of the invention, with the embodiment of FIGS. 18 through 22 it might prove prohibitive to break the heat stake welds between the chamber insert 314 and front surface 304 of the housing 300 to remove the insert 314.

It should be appreciated that the invention includes modifications and variations to the embodiments of the invention described herein.

What is claimed is:

1. A self contained viscous liquid dispenser, comprising:

a housing defining an internal liquid reservoir, said housing including a front surface having an opening therethrough adjacent a bottom surface of said reservoir;

an insert member fitted through said opening, said insert extending into said reservoir and defining an internal pump chamber having a back end open to said reservoir and a front end open to the outside of said housing, said front end of said insert member attached to said housing at said front surface such that said pump chamber is disposed substantially rearwardly of said front surface of said housing;

a pump cylinder slidably disposed and retained in said pump chamber, said pump cylinder having a delivery end extending out of said pump chamber and a delivery channel defined therethrough terminating at a dispensing orifice in said delivery end, said pump cylinder movable within said pump chamber from a rest position to a pressurizing position to pressurize and dispense liquid within said pump chamber through said delivery channel and out said dispensing orifice; and an actuator configured with said delivery end of said pump cylinder to move said pump cylinder from said rest position to said pressurizing position from outside of said housing.

2. The dispenser as in claim 1, further comprising a valve mechanism disposed in said delivery end of said pump cylinder, said valve mechanism opening upon an operator actuating said actuator and closing upon release of said actuator to prevent leakage or dripping of liquid from said pump cylinder.

3. The dispenser as in claim 2, wherein said valve mechanism comprises at least one flexible flap member that is movable to an open position upon actuation of said actuator and automatically returns to a closed position upon release of said actuator.

4. The dispenser as in claim 3, further comprising a plurality of said flap members that define an opening therethrough in said open position and seal against each other in said closed position.

5. The dispenser as in claim 1, wherein said pump cylinder is insertable into said pump chamber from said back end, said chamber further comprising retaining structure at said front end to prevent withdrawal of said pump cylinder from said pump chamber through said front end.

6. The dispenser as in claim 5, further comprising an end cap attachable to said back end of said pump chamber upon insertion of said pump cylinder within said pump chamber.

7. The dispenser as in claim 6, further comprising an orifice defined through said cap member for drawing viscous liquid into said pump chamber, and a check valve device disposed in said orifice to close said orifice upon movement of said pump cylinder to said pressurization position.

8. The dispenser as in claim 7, wherein said check valve device further comprises a sealing cap disposed to seal said orifice upon movement of said pump cylinder to said pressurization position.

9. The dispenser as in claim 1, wherein said actuator comprises a panel member pivotally connected to said housing and in contact against said delivery end of said pump cylinder.

10. The dispenser as in claim 1, wherein said actuator is attached directly to said delivery end of said pump cylinder.

11. The dispenser as in claim 1, wherein said pump cylinder comprises a first component having a first channel defined therethrough, and a second component fitted into said first component and having a second channel defined therethrough that is axially aligned with said first channel, said first and second channels defining said delivery channel through said pump cylinder.

12. The dispenser as in claim 11, wherein said first component further comprises a first radially extending seal that slidably engages along an inner wall of said insert member defining said pump chamber, and said second component further comprises a second radially extending seal that also slidably engages along said inner wall of said insert member.

13. The dispenser as in claim 1, further comprising a biasing element disposed within said pump chamber to bias said pump cylinder to said rest position.

14. The dispenser as in claim 1, further comprising at least one seal disposed between an outer surface of said insert member and said housing.

15. The dispenser as in claim 14, wherein said at least one seal comprises a radially inward extending seal disposed around said opening in said housing that engages and seals against said outer surface of said insert member.

16. The dispenser as in claim 15, wherein said opening in said housing is defined by a cylindrical extension that extends from said front surface into said reservoir, said radially extending seal disposed on said cylindrical extension.

17. The dispenser as in claim 14, wherein said insert member comprises a radially outward extending seal disposed at a forward end thereof that engages and seals against a portion of said housing defining said opening.

18. The dispenser as in claim 1, further comprising a first and a second seal between an outer surface of said insert member and said housing, said first seal comprising a radially inward extending seal disposed around said opening in said housing that engages and seals against said outer surface of said insert member, and said second seal comprising a radially outward extending seal disposed at a forward end of said insert member that engages and seals against a portion of said housing defining said opening.

19. A self contained viscous liquid dispenser, comprising:

a housing defining an internal liquid reservoir, said housing including a front surface having an opening therethrough adjacent a bottom surface of said reservoir;

an insert member fitted through said opening, said insert extending into said reservoir and defining an internal pump chamber having a back end open to said reservoir and a front end open to the outside of said housing, said insert attached to said housing at said front surface;

a pump cylinder slidably disposed and retained in said pump chamber, said pump cylinder having a delivery end extending out of said pump chamber and a delivery channel defined therethrough terminating at a dispensing orifice in said delivery end, said pump cylinder movable within said pump chamber from a rest position to a pressurizing position to pressurize and dispense liquid within said pump chamber through said delivery channel and out said dispensing orifice;

an actuator configured with said delivery end of said pump cylinder to move said pump cylinder from said rest position to said pressurizing position from outside of said housing; and further comprising a locking mechanism disposed between said pump cylinder and said pump chamber to retain said pump cylinder locked in said pressurization position during storage and transit of said dispenser.

20. The dispenser as in claim 19, wherein said locking mechanism comprises a circumferentially extending groove defined in an exterior surface of said pump cylinder at a position corresponding to said pressurization position, and a radially extending tab configured on said insert member that engages in said groove.

21. A self contained viscous liquid dispenser, comprising:

a housing defining an internal liquid reservoir, said housing including a front surface having an opening therethrough adjacent a bottom surface of said reservoir;

an insert member fitted through said opening, said insert extending into said reservoir and defining an internal pump chamber having a back end open to said reservoir and a front end open to the outside of said housing, said insert attached to said housing at said front surface;

a pump cylinder slidably disposed and retained in said pump chamber, said pump cylinder having a delivery end extending out of said pump chamber and a delivery channel defined therethrough terminating at a dispensing orifice in said delivery end, said pump cylinder movable within said pump chamber from a rest position to a pressurizing position to pressurize and dispense liquid within said pump chamber through said delivery channel and out said dispensing orifice;

an actuator configured with said delivery end of said pump cylinder to move said pump cylinder from said rest position to said pressurizing position from outside of said housing; and wherein said housing comprises a plurality of protrusions extending from said front surface and disposed around said opening, and insert member comprises a front flange having a plurality of holes defined therethrough into which said protrusions extend upon mounting said insert member into said housing.

22. The dispenser as in claim 21, wherein said holes are counter-bored and said protrusions have been melted so as to flow into said holes to permanently retain said insert member relative to said housing.

23. A self contained viscous liquid dispenser, comprising:

a housing defining an internal liquid reservoir, said housing further comprising a back side configured for securement against a supporting wall surface;

a pump chamber defined in said reservoir, said pump chamber having a back end open to said reservoir and a front end open to the outside of said housing;

a pump cylinder slidably disposed and retained in said chamber, said pump cylinder having a delivery end extending out of said pump chamber and a delivery channel defined therethrough terminating at a dispensing orifice in said delivery end, said pump cylinder movable within said pump chamber from a rest position to a pressurizing position to pressurize and dispense liquid within said pump chamber through said delivery channel and out said dispensing orifice;

said pump cylinder further comprising a first component having a first channel defined therethrough, and a second component fitted into said first component and having a second channel defined therethrough that is axially aligned with said first channel, said first and second channels defining said delivery channel; and an actuator configured with said delivery end of said pump cylinder to move said pump cylinder from said rest position to said pressurizing position.

24. The dispenser as in claim 23, wherein said first component further comprises a first radially extending seal that slidably engages along a wall defining said pump chamber, and said second component further comprises a second radially extending seal that also slidably engages along said wall defining said pump chamber.

25. The dispenser as in claim 23, further comprising a valve mechanism disposed in said delivery end of said pump cylinder, said valve mechanism opening upon an operator actuating said actuator and closing upon release of said actuator to prevent leakage or dripping of liquid from said pump cylinder.

26. The dispenser as in claim 25, wherein said valve mechanism comprises at least one flexible flap member that is movable to an open position upon actuation of said actuator and automatically returns to a closed position upon release of said actuator.

27. The dispenser as in claim 23, further comprising an end cap attachable to said back end of said pump chamber subsequent to insertion of said pump cylinder within said pump chamber.

28. The dispenser as in claim 27, further comprising an orifice defined through said cap member for drawing viscous liquid into said pump chamber, and a check valve device disposed in said orifice to close said orifice upon movement of said pump cylinder to said pressurization position.

29. The dispenser as in claim 28, wherein said check valve device further comprises a sealing cap disposed to seal said orifice upon movement of said pump cylinder to said pressurization position.

30. The dispenser as in claim 23, wherein said actuator comprises a panel member pivotally connected to said housing and in contact against said delivery end of said pump cylinder.

31. The dispenser as in claim 23, wherein said actuator is attached directly to said delivery end of said pump cylinder.

* * * * *